US010221509B2

(12) United States Patent
Grassi et al.

(10) Patent No.: US 10,221,509 B2
(45) Date of Patent: Mar. 5, 2019

(54) METHOD AND MACHINE FOR PRODUCING A KNITTED ARTICLE WITH BODY AND LEG PIECES, AND ARTICLE THUS OBTAINED

(71) Applicant: GOLDEN LADY COMPANY S.P.A., Castiglione delle Stiviere (IT)

(72) Inventors: Nerino Grassi, Castiglione delle Stiviere (IT); Paolo Conti, Firenze (IT)

(73) Assignee: GOLDEN LADY COMPANY S.P.A., Castiglione delle Stiviere (IT)

( * ) Notice: Subject to any disclaimer, the term of this patent is extended or adjusted under 35 U.S.C. 154(b) by 27 days.

(21) Appl. No.: 15/029,850

(22) PCT Filed: Oct. 17, 2014

(86) PCT No.: PCT/EP2014/072295
§ 371 (c)(1),
(2) Date: Apr. 15, 2016

(87) PCT Pub. No.: WO2015/055803
PCT Pub. Date: Apr. 23, 2015

(65) Prior Publication Data

US 2016/0251783 A1 Sep. 1, 2016

(30) Foreign Application Priority Data

Oct. 17, 2013 (IT) ..... FI2013A0247

(51) Int. Cl.
*D04B 9/20* (2006.01)
*D04B 1/24* (2006.01)
*D04B 1/10* (2006.01)
*D04B 35/34* (2006.01)

(52) U.S. Cl.
CPC ..... *D04B 1/243* (2013.01); *D04B 1/108* (2013.01); *D04B 9/20* (2013.01); *D04B 35/34* (2013.01); *D10B 2501/021* (2013.01)

(58) Field of Classification Search
CPC . D04B 1/243; D04B 1/26; D04B 9/20; D04B 9/26; D04B 9/46
See application file for complete search history.

(56) References Cited

U.S. PATENT DOCUMENTS 2,962,884 A 12/1960 Garrou et al.
3,109,300 A * 11/1963 Garrou ..... A41B 9/04 66/177
3,673,821 A * 7/1972 Johnson ..... A41B 11/14 2/409

(Continued)

FOREIGN PATENT DOCUMENTS

DE 25 48 208 A1 5/1977
EP 0 454 196 A2 10/1991

(Continued)

*Primary Examiner* — Danny Worrell
(74) *Attorney, Agent, or Firm* — McGlew and Tuttle, P.C.

(57) ABSTRACT

According to the invention, a garment (1) is produced, comprising two leg pieces (3, 5) and a body, wherein the body (7) comprises two side pockets (17, 19) of fabric and preferably a central portion (15) between the two side pockets. The body is produced with a plurality of feeds of yarns. Moreover, the pockets are formed with reciprocating motion and the central portion with continuous motion of the needle cylinder.

37 Claims, 32 Drawing Sheets

(56) References Cited

U.S. PATENT DOCUMENTS

| | | | | | |
|---|---|---|---|---|---|
| 3,748,870 | A | * | 7/1973 | Fregeolle | A41B 11/14 66/177 |
| 3,802,229 | A | | 4/1974 | Fregeolle | |
| 3,924,423 | A | * | 12/1975 | Lonati | D04B 1/243 66/172 E |
| 3,996,768 | A | * | 12/1976 | Gariboldi | D04B 1/243 66/177 |
| 4,000,630 | A | * | 1/1977 | Imboden | D04B 1/243 66/177 |
| 4,022,035 | A | | 5/1977 | Lonati | |
| 4,034,578 | A | * | 7/1977 | Conti | D04B 1/243 66/177 |
| 4,041,736 | A | | 8/1977 | Fregeolle | |
| 4,070,874 | A | * | 1/1978 | Zouhar | D04B 1/243 66/177 |
| 4,100,769 | A | * | 7/1978 | Nurk | D04B 1/243 2/409 |
| 2012/0131721 | A1 | | 5/2012 | Conti | |

FOREIGN PATENT DOCUMENTS

| | | | |
|---|---|---|---|
| EP | 0 454 631 | A2 | 10/1991 |
| GB | 1235361 | A | 6/1971 |
| GB | 1 239 049 | A | 7/1971 |
| GB | 2 006 840 | A | 5/1979 |
| GB | 2 078 265 | A | 1/1982 |
| JP | 47-9392 | A | 3/1972 |
| JP | H08269803 | A | 10/1996 |
| WO | 2012/014246 | A1 | 2/2012 |

* cited by examiner

Fig.1
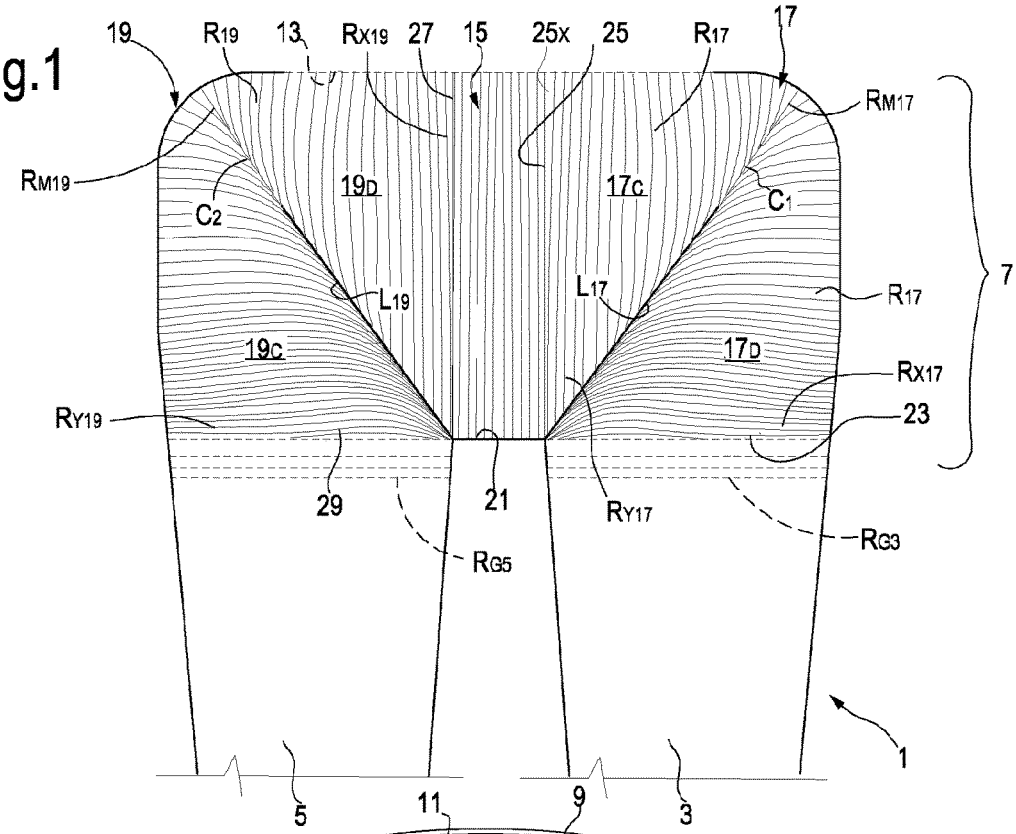
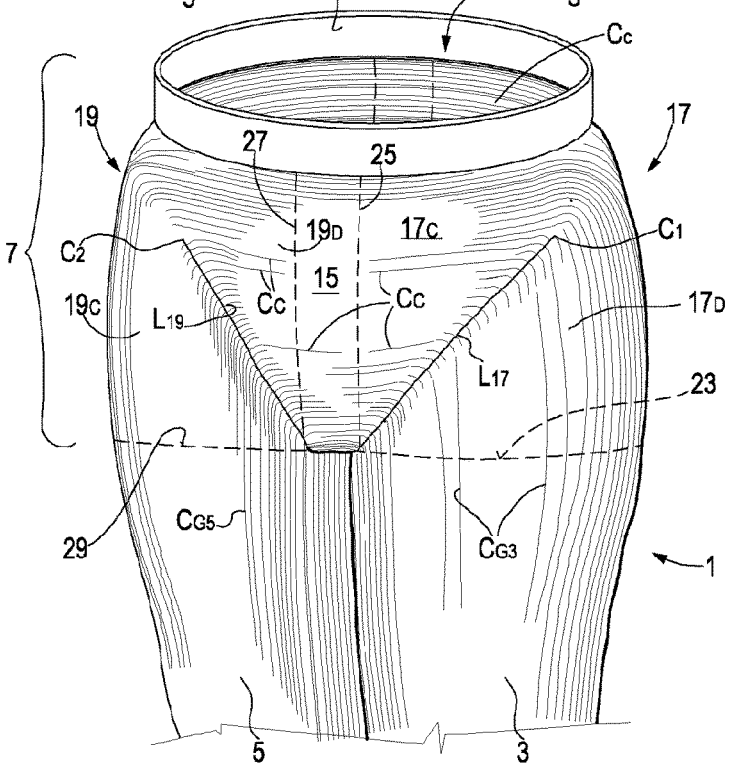
Fig.2

METHOD AND MACHINE FOR PRODUCING A KNITTED ARTICLE WITH BODY AND LEG PIECES, AND ARTICLE THUS OBTAINED

TECHNICAL FIELD

The present invention concerns improvements to methods for producing articles or garments comprising two leg pieces and one body, for instance pantyhose, tights or the like. Especially, the present invention relates to methods for producing seamless garments of the above mentioned type using a single knitting process onto a circular knitting machine provided with single or double needle bed.

BACKGROUND ART

In the field of production of tights, pantyhose and similar knitted articles, there is a continuous search for new methods and systems for automating the knitting process, to obtain a seamless continuous article or garment, knitted on a circular machine in a single production process.

Some searches are based on a process developed in the '60s, which provides for a tubular article to be knitted during a single process onto a circular knitting machine starting from an end of a first leg piece up to an end of a second leg piece, knitting three subsequent tubular portions or sections to form, in addition to the two leg pieces, the body of the article. The tubular article unloaded form the circular knitting machine is then cut in the central area to form an opening around which an elastic edge is sewn to form the body waist. This known process is detailed in the GB-1235361. To increase its fit, the body is knitted with wider stitches, so that the central portion of the tubular article or garment has a slightly greater section than the section of the leg pieces.

The method described in GB-1235361 is very fast as it can be performed on a circular knitting machine with continuous motion. However, the article produced by means of this method had low success as the body, being formed with a tubular fabric with the same number of stitches per raw as the tubular legs, did not fit sufficiently closely. More in particular, the body height was too limited and the elastic edge was too close to the crotch line.

Many improvements to this method have been studied, trying to overcome the limits and drawbacks thereof.

U.S. Pat. No. 2,962,884 discloses a method wherein, after having knitted the first leg piece and before knitting the second leg piece, two pockets of fabric are produced on the circular knitting machine by knitting with reciprocating motion rows of gradually decreasing and then increasingly length. The two pockets knitted with reciprocating motion form the body of the garment, which thus fits more than the body produced with the method originally described in GB-1235361.

However, the method disclosed in U.S. Pat. No. 2,962,884 is particularly slow as most of the garment, and especially the whole body, is knitted by means of reciprocating motion with only one feed, i.e. feeding only one yarn to the needle cylinder and therefore forming only one row of stitches at every rotation of the needle cylinder. Regardless of this inconvenience, at the present time seamless tights are produced using this method. Especially, the seamless tights of the Austrian company Wolford are produced with this method, combining continuous motion for knitting the leg pieces and reciprocating motion for knitting the body.

U.S. Pat. No. 4,022,035 describes a method for producing tights in a single process on a circular knitting machine with a technique similar to that of U.S. Pat. No. 2,962,884. In this further embodiment, while knitting the body central portion with reciprocating motion the needles are precisely selected so as to form the opening of the garment directly onto the circular machine. Also this process is particularly slow, as it is mostly made with reciprocating motion of the needle cylinder.

There is therefore a need to further improve the methods for knitting pantyhose, tights and similar articles or garments having a body and two leg pieces, using a single process onto a circular knitting machine, which overcome or reduce the drawbacks of the known methods that are still used.

SUMMARY OF THE INVENTION

To produce an article or garment with one body and two leg pieces by means of a more efficient and faster process, a method comprising the following steps is provided:

- knitting with continuous motion a first leg piece with a plurality of feeds;
- knitting with reciprocating motion a first pocket of fabric with a plurality of feeds, starting from an end row of the first leg piece, said first pocket of fabric forming a first side part of the body;
- preferably, knitting with continuous motion a central part of the body with a plurality of feeds;
- knitting with reciprocating motion a second pocket of fabric with a plurality of feeds, starting from the central part of the body up to a start row of a second leg piece, said second pocket forming a second side part of the body;
- knitting with continuous motion the second leg piece with a plurality of feeds.

Knitting the whole body with a plurality of feeds allows achieving a high production speed. Forming the two side pockets of fabric improves the garment snug-fit. Using the reciprocating motion only for forming the side pockets allows having a particularly regular fabric that is comfortable to be worn, while using the continuous motion for knitting a central or intermediate portion of the body allows decreasing the time necessary to produce the garment.

In some embodiments, the method further comprises the steps of:

- arranging a plurality of feeds around the circular needle bed, each feed comprising: a feed for feeding the circular needle bed with a respective yarn; a cam for lifting the needles; and a cam for lowering the needles;
- associating to each feed a first selector operated to select the needles while the circular needle bed rotates clockwise, and a second selector operated to select the needles while the circular needle bed rotates counterclockwise;
- according to the direction of rotation of the circular needle bed, selectively actuating the first selector or the second selector while knitting the first pocket and the second pocket of fabric with reciprocating motion.

In advantageous embodiments, the number of feeds used for knitting the different parts of the garment is always the same. Preferably, above all if Z-yarns and S-yarns are used for forming the various rows of stitches, there is an advantage in using an even number of feeds.

In some embodiments two feeds are used. However, the number of feeds will be preferably greater, for instance four or six feeds, as long as the diameter dimension of the needle cylinder allows it. Generally speaking, the greater the number of feeds, the higher the production speed.

In some embodiments the step of knitting the first pocket of fabric with reciprocating motion comprises the steps of:

knitting with reciprocating motion a first sequence of partial rows, starting from the first leg piece, gradually reducing the number of operating needles, thus forming partial rows of gradually decreasing length, up to a group of partial rows of minimal length;

knitting with reciprocating motion a second sequence of partial rows, starting from the group of partial rows of minimal length, gradually increasing the number of operating needles, thus forming partial rows of gradually increasing length.

Each time the circular needle bed rotates in one direction and each time the circular needle bed rotates in the opposite direction a plurality of rows is formed in a number corresponding to the number of feeds. In some embodiments, the groups of rows formed at every angular stroke of the needle cylinder in one direction and in the opposite direction can have the same length, even if this is not strictly necessary.

In the present description and the attached claims, length of a row of stitches generally means the length represented as the number of stitches. Two rows of equal length are therefore formed by the same number of stitches.

In a mirror-like way, the step of knitting the second pocket of fabric with reciprocating motion comprises the steps of:

knitting a third sequence of partial rows with reciprocating motion, starting from the body central part, gradually decreasing the number of operating needles, thus forming partial rows of gradually decreasing length, up to a group of partial rows of minimal length;

knitting a fourth sequence of partial rows with reciprocating motion, starting from the group of partial rows of minimal length, gradually increasing the number of operating needles, thus forming partial rows of gradually increasing length.

Every time the circular needle bed rotates in one direction and every time the circular needle bed rotates in the opposite direction a plurality of rows is formed in a number corresponding to the number of feeds. In this case again, the rows formed at every rotation or angular stroke of the needle cylinder may be of equal or different length.

To achieve better aesthetic appearance and higher tensile strength of the fabric, the plurality of partial rows formed through rotation of the needle bed in one direction or in the opposite direction (i.e. at every angular stroke of the needle cylinder) while knitting the first and the second pocket of fabric with reciprocating motion are shifted one with respect to the other by a suitable number of stitches. This allows a better distribution of stresses in the knitted fabric structure when the garment is worn, thus reducing the risk of breakage, with respect to what occurs if all rows formed at every reciprocating movement of the needle cylinder end at the same point, i.e. at the same column of stitches. Practically, shifting the ends of the consecutive partial rows knitted with reciprocating motion results in these ends being arranged along a band of fabric comprising a plurality of columns of stitches, instead of being concentrated on two columns of stitches.

In some embodiments, the partial rows are shifted with respect to one another by a number of stitches comprised between 2 and 15, preferably between 3 and 10 and more preferably between 3 and 7. In some embodiments, the shifting of the ends of consecutive partial rows is fixed both while forming decreased rows (i.e. rows of decreasing length) and increased rows (i.e. of increasing length). However, this is not strictly necessary. According to some embodiments, while forming the pocket of fabric the number of stitches by which consecutive rows are shifted may be different for consecutive rows and may even change along the extension of the pocket of fabric. For instance, there could be a shifting by N stitches while knitting the first decreasing rows, and then by M stitches, where M is different than N.

According to a further aspect, the invention provides a knitted article or garment comprising a body and two tubular leg pieces, wherein the body comprises two side pockets of knitted fabric, each pocket being formed by a first series of partial rows, constituting the extension of a knitted fabric forming the two tubular leg pieces, the rows of said first series of partial rows having decreasing length starting from the respective leg piece up to a group of partial rows of minimal length of the respective pocket, and by a second series of partial rows, having increasing length starting from the respective group of partial rows of minimal length up to a respective complete row; and wherein said pockets of fabric are formed with a plurality of feeds with reciprocating motion.

The (reciprocating or continuous) motion of the needle cylinder results in a given arrangement of the rows of stitches in the finished garment, corresponding to the trajectory according to which the stitches are formed. In the portions of fabric knitted with continuous motion, the rows are arranged according to a continuous helical line, whilst in the areas of fabric knitted with reciprocating motion the rows are arranged according to a zigzag pattern. Therefore, defining the structure of the various areas of fabric of the garment by indicating the type of motion used for knitting it corresponds to defining an arrangement of the rows of stitches forming the fabric.

Advantageously, the body further comprises a central portion arranged between the two pockets of fabric and formed with continuous motion with a plurality of feeds.

The partial rows formed with the plurality of feeds and corresponding to each reciprocating knitting movement are advantageously shifted with respect to one another, so that the ends of the partial rows are spaced from one another by a number of stitches equal to or greater than 1, and preferably equal to or greater than 2 and more preferably equal to or greater than 3.

According to a further aspect, the invention relates to a knitting machine comprising a needle cylinder with a circular needle bed, a cam mantle and selectors, a plurality of feeds for yarns, and a control unit, wherein said control unit executes a program implementing a knitting method as described above.

Characteristics and embodiments are described hereunder and further defined in the attached claims, which form an integral part of the present description. The above brief description identifies characteristics of the various embodiments of the present invention, so that the detailed description below may be better understood and in order that the contributions to the art may be better appreciated. There are obviously other characteristics of the invention which will be described further on and which will be indicated in the attached claims. With reference to this, before illustrating different embodiments of the invention in detail, it must be understood that the various embodiments of the invention are not limited in their application to the construction details and to the arrangements of components described in the following description or illustrated in the drawings. The invention may be implemented in other embodiments and implemented and placed in use in various ways. Also, it is necessary to understand that the phraseology and terminology used here are only for descriptive purposes and must not be considered as limiting.

Persons skilled in the art will therefore understand that the concept on which the invention is based may be promptly used as a base for designing other structures, other methods and/or other systems to implement the various objects of the present invention. It is therefore important that the claims be considered as comprising those equivalent constructions which do not deviate from the spirit and scope of the present invention.

BRIEF DESCRIPTION OF THE DRAWINGS

The invention will be better understood by following the description and accompanying drawing, which shows non-limiting practical embodiments of the invention. More particularly, in the drawing:

FIG. 1 is a schematic front view of a portion of a knitted article or garment produced with the method described herein;

FIG. 2 is a perspective view of the garment of FIG. 1;

DETAILED DESCRIPTION OF EMBODIMENTS OF THE INVENTION

The detailed description below of example embodiments is made with reference to the attached drawings. The same reference numbers in different drawings identify the equal or similar elements. Furthermore, the drawings are not necessarily to scale. The detailed description below does not limit the invention. The protective scope of the present invention is defined by the attached claims.

In the description, the reference to "an embodiment" or "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

FIG. 1 schematically shows a flattened front view of an article or garment produced according to the method described below. FIG. 2 is a perspective view of the same article or garment.

Figure 3:
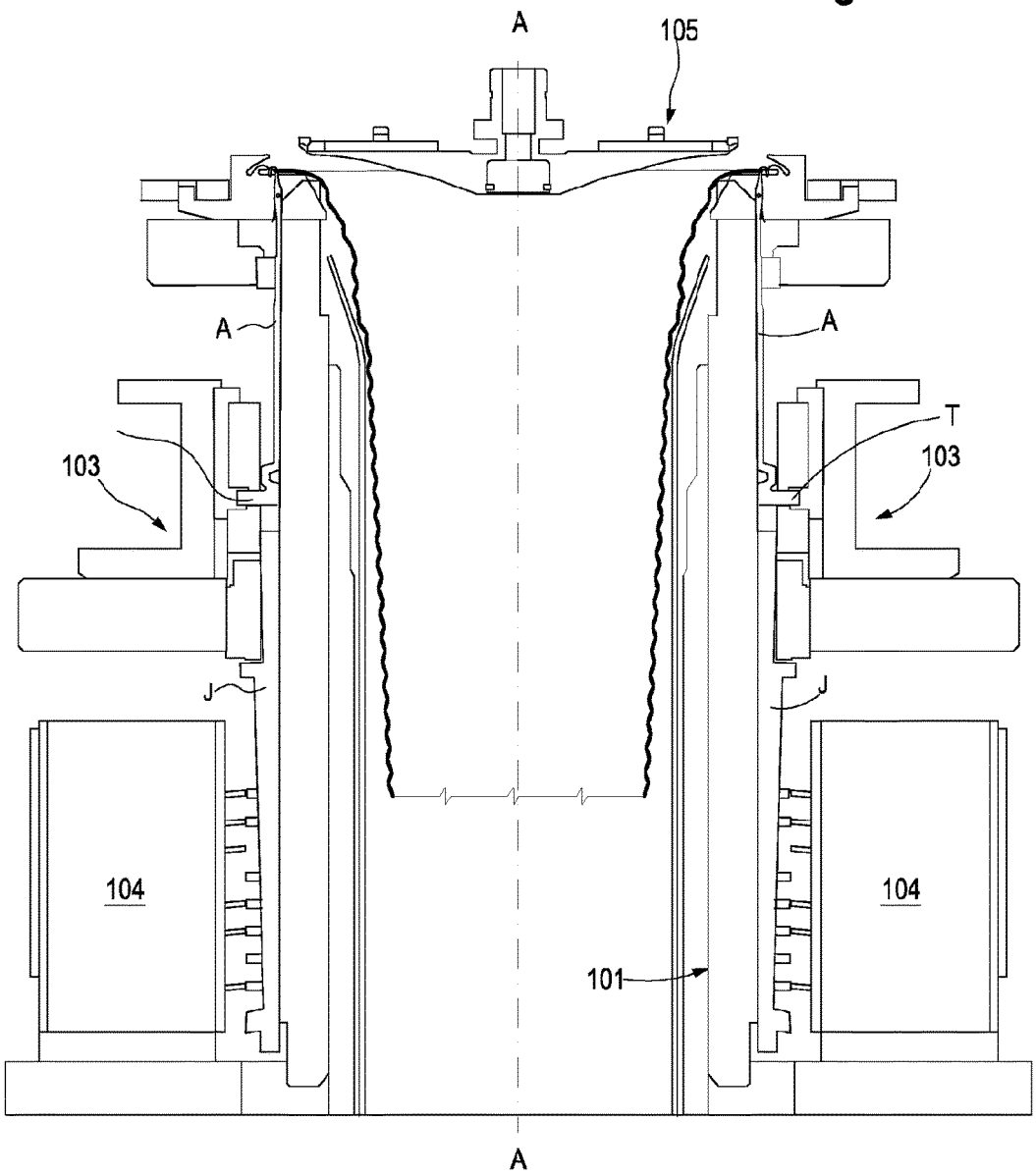
FIG. 3 is a schematic longitudinal cross-section of a circular knitting machine for producing a garment using the method described herein.

FIG. 3 schematically shows a section according to a vertical plane containing the axis of rotation of the needle cylinder of a knitting machine by means of which a garment can be knitted using the method described herein. As well known, the machine comprises a needle cylinder 101 provided with a circular needle bed and, as the case may be, jacks J arranged below each needle A. The cylinder 101 rotates with continuous or reciprocating motion, according to the knitting steps as described below, around its own axis A-A, so that the needles can knit the garment with yarns fed from two or more feeds, not shown in this figure. The movement of the needles is controlled by means of groups of cams 103, selectors 105 and any other members necessary for controlling the needles. The needle actuating and controlling members are preferably stationary, i.e. they do not rotate around the axis A-A of the needle cylinder 101. A dial 105 may be associated with the needle cylinder 101. In other embodiments, as it is well known, the machine may comprise two superimposed needle cylinders. The details of the knitting machines usable for knitting garments of the type described herein are well known to those skilled in the art and do not require further explanations. However, some features of the control cams used to optimize the machine according to the knitting method of the invention will be described below.

In some embodiments the garment or article, indicated as a whole with reference number 1, comprises a first tubular leg piece 3 and a second tubular leg piece 5. Each of the two tubular leg pieces 3 and 5 extends from a respective toe or end (not shown), that can be open ore closed, up to a body 7. The tubular leg pieces may extend up to ends forming respective feet of the article, for instance in the case of tights or pantyhose. In other embodiments the tubular leg pieces 3 and 5 may be shorter and can comprise even few rows of stitches so as to form, together with the body 7, a sort of knickers.

The body 7 has an opening 9 surrounded by a finishing edge indicated with 11, preferably an elastic edge. The elastic edge 11 is shown in FIG. 2, while FIG. 1 shows a not yet completed article or garment, and in particular an article before the edge 11 has been applied thereto. It has only an opening 13 in the upper part of the body 7, along the edges of which the edge 11 is subsequently sewn. The opening 13 can be made by cutting it after having knitted the garment 1.

In advantageous embodiments the body 7 comprises three portions: a central portion 15 and two side portions 17 and 19. As it will be better detailed below, each of the side portions 17 and 19 comprises at least one respective pocket of fabric.

Each pocket of fabric forming the two side portions 17, 19 comprises partial rows of stitches having gradually decreasing and gradually increasing lengths produced with reciprocating motion of the needle cylinder. Vice versa, the central portion 15 of the body 7 can be advantageously knitted with continuous motion of the needle cylinder, similarly to the leg pieces.

In all the knitting steps, the needles of the cylinder are fed with at least two feeds, i.e. with at least two yarns. In preferred embodiments, four feeds are provided to feed four yarns to the circular bed of needle A of the cylinder 101. If the diameter dimension of the needle cylinder allows it, the number of feeds can be also greater than four, for instance six or more feeds. In this way the time necessary to produce the article or garment is reduced and the finished product has a greater quality. In fact, at every rotation of the needle cylinder 101 a number of (complete or partial) rows is formed equal to the number of fed yarns.

Thanks to the pockets 17, 19 of fabric the snug-fit of the garment is improved, the elasticity of the body central portion is not limited and the article or garment can be therefore used also by people wearing relatively large sizes.

In some embodiments the article or garment 1 is produced with a single knitting operation on a circular machine, for instance a single-cylinder circular machine with dial, as the case may be.

The knitting process is substantially comprised of a sequence of steps, at the end whereof a complete article with body and tubular leg pieces is produced. More in particular, the knitting process may be for instance subdivided into seven consecutive steps, as it will be explained below.

The knitting process can indifferently start from the tubular leg piece 3 or from the tubular leg piece 5. For the sake of practicality of the description, reference will be made below to a process starting with the knitting of the tubular leg piece 3 and ending with the knitting of the tubular leg piece 5, being however understood that the process can be reversed, starting with the knitting of the tubular leg piece 5 and ending with the knitting of the tubular leg piece 3.

In a first knitting step on the circular knitting machine 101 (FIG. 2) the tubular leg piece 3 is knitted using a traditional knitting with continuous motion, wherein the needle control cams are preferably stationary and the needle cylinder 101 rotates with continuous motion around its own axis A-A. For knitting the tubular leg piece 3 it is possible to use all the needles or to select some of them to produce particular knitting effects. However, as the leg piece has a tubular extension, rows of stitches are generally formed that, at least partially, extend for all the circumference of the needle bed.

For knitting the tubular leg piece 3 it is possible to feed the circular bed of needles A with one or more feeds, i.e. with one or more yarns. At least four feeds are preferably used and more in general an even number of feeds, for instance six feeds. In this way, every time the needle cylinder rotates, a number of rows is formed equal to the number of feeds.

With at least two feeds, coated yarns of the Z-type or S-type can be used, i.e. for instance yarns with an elastomer core coated by filaments twisted clockwise (Z-yarn) and counterclockwise (S-yarns). As it is well known to those skilled in the art, the use of Z-yarns and S-yarns at the same time allows a better consistency of the article, which does not tend to twist.

Instead of using S-yarns and Z-yarns in combination, it is possible to use so called doubled yarns, i.e. wherein coating yarns are twisted around an elastomer core according to opposite helices, so that the yarn does not tend to twist. The doubled yarns are however more expensive than S-twist and Z-twist yarns; therefore the opportunity of using Z-yarns and S-yarns instead of doubled yarns is a significant economic advantage.

The knitting of the tubular leg piece 3 ends with the formation of a last circular row of stitches, indicated with 23. The complete row 23 is preferably comprised of a number of stitches equal to the number of needles with which the circular knitting machine is provided, even if this is not compulsory. It is only important that this row is complete, i.e. it extends around the whole leg piece.

Rows of stitches extending substantially horizontally, indicated with RG3 in FIG. 1, are therefore formed along the tubular leg piece 3. The stitches forming the rows RG3 are arranged according to substantially longitudinal columns of stitches along the extension of the tubular leg piece 3, as shown with CG3 in FIG. 2.

A second step of the process is then performed on the circular knitting machine; this step consists of knitting a first series of partial rows of gradually decreasing length with reciprocating motion to form a first portion 17D of the pocket 17 of fabric. How this portion of pocket and the remaining portions of the pockets 17, 19 are formed will be described in greater detail here below, with reference to FIG. 4 and to the sequence of FIGS. 5A-5M.

Similarly to the leg pieces, also the portion 17D of the pocket 17 is knitted with a plurality of feeds. Preferably, a number of feeds is used equal to the number of feeds used for knitting the first tubular leg piece 3, i.e. at least two and preferably at least four or more feeds.

The portion 17D of the pocket 17 can be formed with the same yarns used for knitting the tubular leg piece 3. In other embodiments some or all yarns may be replaced, so that the portion 17D of the pocket 17 is formed with a number of yarns equal to the number of yarns used for the leg piece 3, but these yarns are of different type; for instance, these yarns may have different denier, or different composition or structure. In some embodiments the type of yarn may be changed once or more times while knitting the portion 17D of the pocket 17.

While the portion 17D of the pocket 17 is being formed, partial rows of stitches, indicated with R17, are sequentially knitted, whose length gradually decreases starting from the last complete row 23, formed while knitting the leg piece 3, up to a row RM17 of minimal length, ending this second step of the knitting process. More precisely, as also the pocket 17 of fabric is knitted with a plurality of feeds and therefore forming a plurality of rows at every revolution of the needle cylinder 101 in one direction or in the opposite direction, the knitting of the portion 17D of the pocket 17 ends with the formation of a number of rows RM17 of minimal length equal to the number of feeds used in this step, for instance four feeds.

The row or group of rows RM17 of minimal length extends from one end point to the other, both indicated with C1, of two opposite lines L17.

As it will be greater detailed below, the single rows formed with the yarns from the various feeds at every reciprocating stroke, i.e. at every rotation of the needle cylinder 101 in one direction or in the opposite direction in the reciprocating motion, are shifted with respect to one another by one or more stitches, preferably by two or more stitches, more preferably by three or more stitches, for instance by from 3 to 10 stitches, for the purposes that will be clearly apparent to those skilled in the art from the detailed description below.

The first group of partial rows knitted while knitting the portion 17D of the pocket 17 of fabric, indicated as a whole with Rx17 in FIG. 1, is knitted by operating only a partial arc of the circular bed of needles A, and it has therefore a lower number of stitches than the number of stitches of the rows forming the leg piece. In case the machine comprises, for instance, 400 needles, each of the rows RG3 of the leg piece 3 (and, similarly, of the leg piece 5) can be comprised of 400 stitches, while the first partial row R17 of the portion 17D of the pocket 17 can comprise a number of stitches equal to nearly the half thereof, as it is knitted by means of a semi-arc of needles A of the cylinder 101, the other needles being inactive. Every time the reciprocating rotation of the needle cylinder 101 is reversed, the length of the partial rows formed with the yarns from the various active feeds decreases. For instance, every time the motion is reversed, the length of the rows can decrease by two stitches, excluding from work one needle at each end of each partial row.

Essentially, the partial rows of the portion 17D knitted in succession by cyclically reversing the direction of rotation of the needle cylinder 101 have therefore gradually decreasing length, i.e. a gradually reduced number of stitches, as they are knitted by excluding from work a gradually increasing number of needles up to the formation of the plurality of partial rows RM17 of minimal length.

Moreover, all the rows formed during a single reciprocating stroke in one direction (clockwise or counterclockwise) with the yarns from the various feeds have preferably the same number of stitches, i.e. the same length. However, the rows formed during each reciprocating stroke or oscillation of the needle cylinder 101 are shifted with respect to one another, i.e. the end stitches of the single rows of equal length are not aligned with one another on a single column but they are shifted by a given number of stitches.

The ends of the partial rows following one another along the portion 17D of the pocket 17 are arranged according to the two opposite delimiting lines L17 extending in an inclined fashion (one on the front and the other on the back of the garment) from the row 23 up to the rows RM17 of minimal length. It must be understood that, even if not shown in the drawing, in the area of the pocket 17 there are actually two substantially mirror-like lines L17, one on the front and the other on the back. These opposite lines L17 are constituted by the alignment of the ends of the partial rows formed in this step of the knitting process.

Once this portion 17D of the pocket 17 has been completely formed, the subsequent step of knitting a second portion labeled 17C of pocket 17 starts. Also the portion 17C of pocket 17 is knitted with a reciprocating motion of the needle cylinder and with gradual increase, i.e. with a gradual increase in the length of the rows following one another while knitting this portion 17C of the pocket 17. Also the portion 17C of the pocket 17 is formed by feeding the needle cylinder 101, which rotates with reciprocating motion, with yarns from a plurality of feeds, preferably the same number of feeds as those used for knitting the leg piece 3 and the portion 17D of the pocket 17.

Therefore, as already described with reference to the rows of decreasing length forming the portion 17D of the pocket 17, while forming the portion 17C of the pocket 17, at every rotation of the needle cylinder 101 in one direction or in the opposite direction, groups of rows are actually formed, each group comprising a number of rows equal to the number of feeds. In the illustrated embodiment, the rows of each group have the same length, i.e. they are comprised of the same number of stitches. This is preferred, but not strictly necessary. In other embodiments the rows of each group may have different length from one another.

Moreover, even if the rows of each group have the same length, they are shifted with respect to one another, similarly to the rows of the groups formed while knitting the portion 17D. The number of stitches, and thus the length of the partial rows, gradually increases from a group of rows to the following one, starting from the minimal length of the rows RM17.

The various partial rows formed during the third step of the knitting process for forming the portion 17C of the pocket 17 join at their ends the partial rows of decreasing length forming the portion 17D. The decreasing partial rows and the increasing partial rows join together along the line L17 as it will be better described below with reference to FIGS. 4, 5A-5M, 6A-6F.

The knitting of the portion 17C of the pocket 17 continues with gradual increase in the length of the single partial rows R17 up to the formation of the last partial row, or more exactly of the last group of partial rows, of the portion 17C, that is indicated with Ry17.

Now the fourth step of the knitting process begins, made with continuous motion of the needle cylinder 101 and starting again from the first complete row 25. The row 25 has an annular extension and is preferably formed by a number of stitches equal to the overall number of needles of the machine. In this fourth step the central portion 15 of the body 7 is knitted with continuous motion of the needle cylinder 101, the needles forming a sequence of complete rows 25X that have annular extension and are substantially parallel to the row 25. The formation of a last complete row 27 concludes the knitting of the central portion 15 of the body 7.

As shown in particular in FIG. 2, in the portion 17C of the pocket 17 and in the central portion 15 of the body 7 the stitches of the formed fabric are arranged according to columns substantially parallel to the edge 11 defining the opening through which the garment or article 1 is worn. Accordingly, the rows of stitches are substantially orthogonal to the columns, as shown in FIG. 1.

In the subsequent fifth knitting step two portions 19D and 19C of the pocket 19 of fabric are formed, using a process essentially symmetrical to that used for forming the pocket 17. While knitting the pocket 19 of fabric a plurality of feeds is used, preferably equal to the number of feeds used in the previous four steps of the knitting process. Every time the needle cylinder 101 rotates in one direction or in the opposite direction, rows are formed in a number equal to the number of feeds and having the same length. The rows, formed at every rotation or reciprocating stroke in one direction or in the opposite direction and preferably having the same length, are shifted with respect to one another. Every time the motion is reversed, the length of the rows decreases, preferably by two stitches.

More in particular, the fifth step of the knitting process comprises the formation of a series of partial rows of gradually decreasing length with reciprocating motion of the needle cylinder 101, starting from the row 27 completing the central portion 15 of the body 7. Rx19 indicates the first group of partial rows. Similarly to the rows Ry17, the partial rows Rx19 can have a number of stitches equal to nearly the half of the number of needles of the cylinder 101. The rows following the partial rows Ry19 are indicated with R19 and have gradually decreasing length.

The partial rows forming the portion 19D of the pocket 19 have ends arranged along two lines L19, only one of which is shown in the drawing and the other one is the mirror of this. The lines L19 are essentially symmetrical to the lines L17.

The formation of a group of partial rows of minimal length indicated with RM19 concludes the fifth step of the knitting process; these partial rows extend from one end point C2 to the other of the two opposite lines L19.

After this fifth knitting step, the sixth knitting step begins, consisting in the formation of the second portion 19C of the pocket 19. In this sixth step partial rows of stitches of gradually increasing length are formed, indicated again with R19, starting from the rows RM19 of minimal length up to a last group of partial rows Ry19 of maximum length. The number of rows formed at every rotation in one direction or in the other direction is equal to the number of feeds and these rows have preferably the same length but they are shifted with respect to one another, as already described with reference to the knitting of the portion 17C.

The subsequent seventh step is the last step of the knitting process; it begins with the formation of a complete row 29 with annular extension preferably formed by a number of stitches equal to the number of needles available on the machine. The knitting continues, forming continuous rows RG5 from the start row 29, constituting the beginning of the tubular leg piece 5, up to the last row of the end thereof (not shown). Starting from the row 29, the knitting is made with continuous motion of the needles and with a number of feeds preferably equal to the number of feeds used for forming the previous portions of the article or garment, for instance four feeds.

Symmetrically to what described with reference to the pocket 17 and the tubular leg piece 3, along the portion 19D of the pocket 19 the columns CC of stitches are arranged substantially parallel to the edge 11, while along the portion 19C and along the leg piece 5 the columns are arranged according to the longitudinal extension of the tubular leg piece 5 as schematically shown by lines CGS.

The process for forming the pockets 17, 19 of fabric with reciprocating motion will be described below in greater detail with reference to FIG. 4 and to the sequence of FIGS. 5A-5M. It should be noted that what described below refers to a particular case, wherein the machine uses four feeds for forming the garment or article 1. This is the currently preferred number of feeds for knitting the garment or article 1. From this exemplary description, those skilled in the art can understand how it is possible to produce an article or garment using a different number of feeds.

Reference will be made below to the step of knitting the pocket 17 that (as briefly described above) begins with the formation of a portion 17D of gradually decreasing rows, i.e. with an area where the row length decreases, followed by the knitting of the area 17C with gradual increase in the length of the partial rows. From the description of these two steps of the knitting process it is easy to understand how the pocket 19 is knitted in a corresponding way.

Below a process will be described, wherein the length of the partial rows decreases in a uniform and linear manner, i.e. at every rotation or pendulum motion of the needle cylinder 101 there is an equal reduction in the length of the rows, said length being understood as the number of stitches forming the single row. Those skilled in the art will understand that this is the preferred operating process, but that the method described herein can be also implemented in a different way, for instance reducing the length of the partial rows by a different number of stitches in subsequent cycles, i.e. reciprocating strokes, while knitting the pocket of fabric.

The pattern of decreases and increases, i.e. of the rows of increasing and decreasing length, in the two pockets 17 and 19 will be preferably mirror-like, but the sequence does not necessarily need to be equal for the front and the rear part of the garment. This means that subsequent rows of different lengths may be increased or decreased in length in a different manner on the two parts (front and rear) of the fabric. In the description below it has been assumed that, every time the motion is reversed, the length of the rows of stitches is reduced by one stitch at each end.

Figure 4:
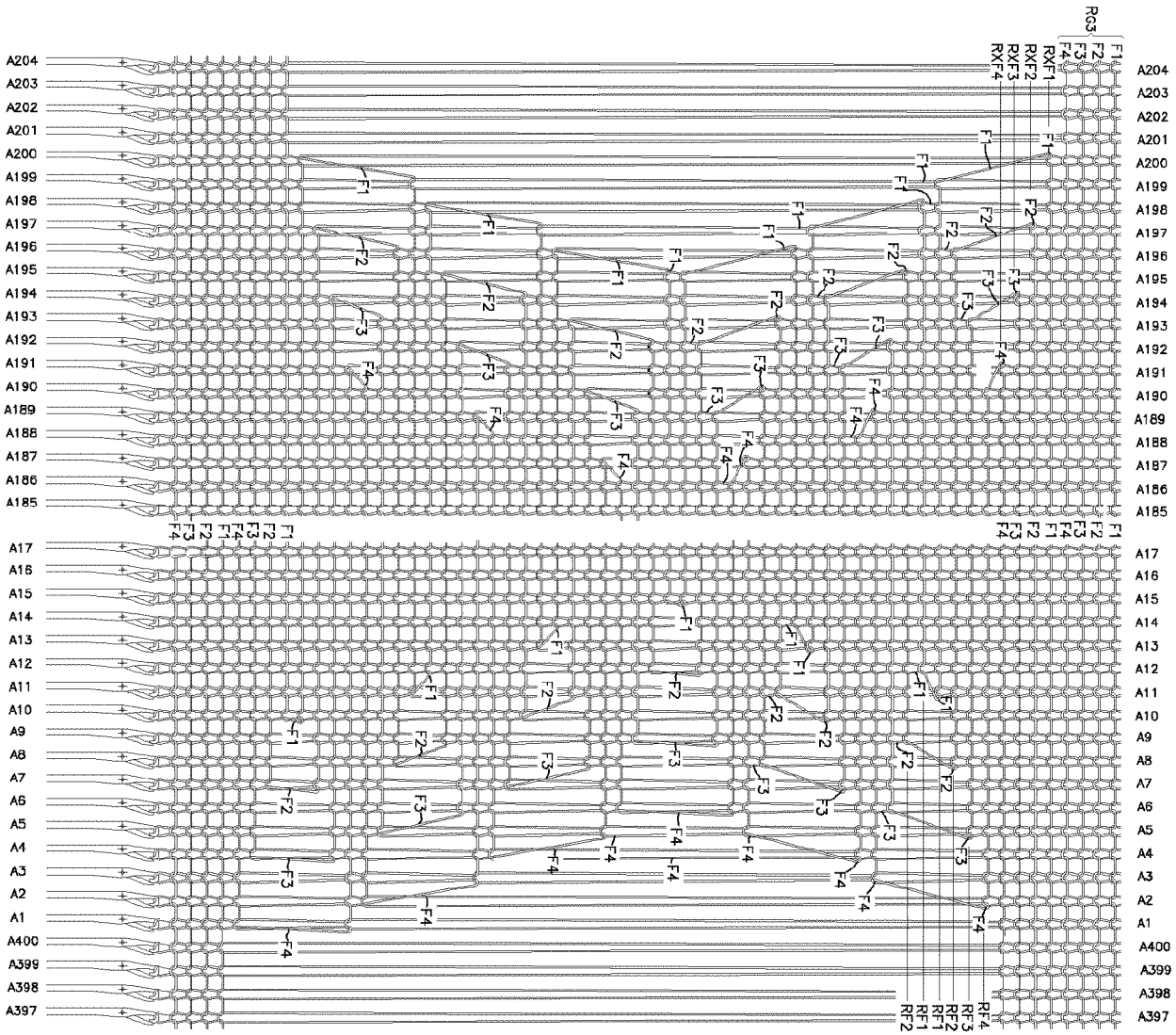
FIG. 4 is a schematic enlargement of the area of the partial rows in a pocket of fabric of the body.

FIG. 4 shows a schematic enlarged simplified view of the fabric formed in the area of the pocket 17. The pocket 19 is formed in a mirror-like way. It should be understood that FIG. 4 shows only a given number of rows; in the reality the number of partial rows forming the pockets 17 and 19 is significantly greater than the number of rows shown in FIG. 4. Moreover, FIG. 4 only shows the area of the decreasing and increasing partial rows, omitting (except for a very limited number of rows) the part of fabric formed with continuous motion before and after the pocket of fabric has been knitted. Moreover, due to the sake of representation, FIG. 4 only shows the ends of the partial rows; these rows are shown interrupted, and the central area thereof is omitted.

In FIG. 4, "Ai" indicates the needles, wherein "i" indicates the sequential number of the needle in the circular needle bed of the machine. In the illustrated example four hundred needles are provided, numbered from A1 to A400. The same reference Ai is used to indicate the stitch formed by the i-th needle. F1, F2, F3, F4 indicate four yarns fed from four distinct feeds with which the machine is provided. The direction of rotation of the cylinder 101 of the needles A is indicated with F.

FIGS. 5A-5M show schematic plan views of the circular bed of needles A, where four feeds are indicated, represented by respective yarn guides G1, G2, G3, and G4, feeding the yarns F1, F2, F3, and F4 respectively. The references G1-G4 will be used also to indicate the respective feeds. F indicates the direction of rotation of the circular needle bed, i.e. of the cylinder 101 of needles A. S1A, S2A, S3A, S4A indicate the selectors for selecting the needles associated with the four feeds G1-G4 respectively, when the needle cylinder 101 rotates in counterclockwise direction. S1O, S2O, S3O and S4O indicate the selectors for the feeds G1-G4 respectively, when the needle cylinder 101 rotates in clockwise direction. FIGS. 5A-5M show only the active selectors, i.e. the selectors that are operating in the respective steps represented in the figures.

Figure 5A:
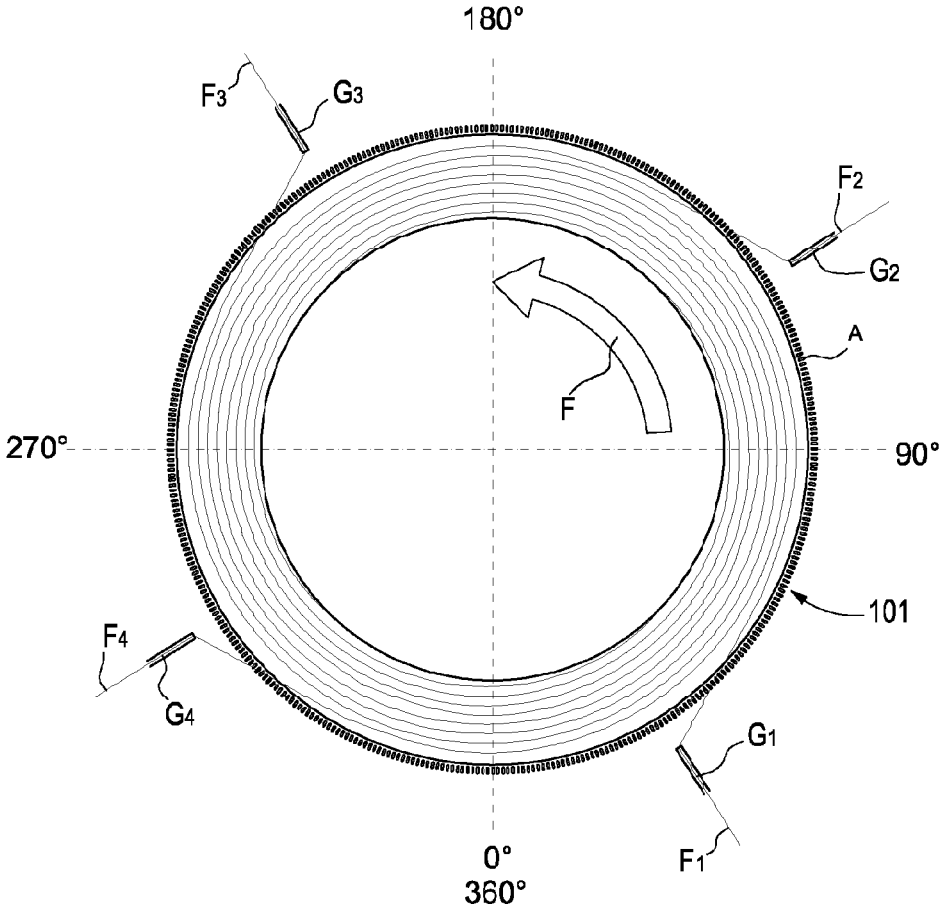
FIGS. 5A-5M show a plan view of a schematic sequence of the method for knitting the rows of decreasing length in a pocket of fabric of the body.

With initial reference to FIG. 4, RG3 indicates the last circular complete rows knitted by means of the cylinder 101 of the machine 1 with continuous motion. In the illustrated embodiment the continuous motion has been assumed to be counterclockwise, just by way of example. FIG. 5A schematically shows this end step of knitting the leg piece 3 with continuous motion.

All the needles A1-A400 of the machine are active and form, with the yarns F1-F4, the last four complete rows, indicated with RG3 in FIG. 4.

Figure 5B:
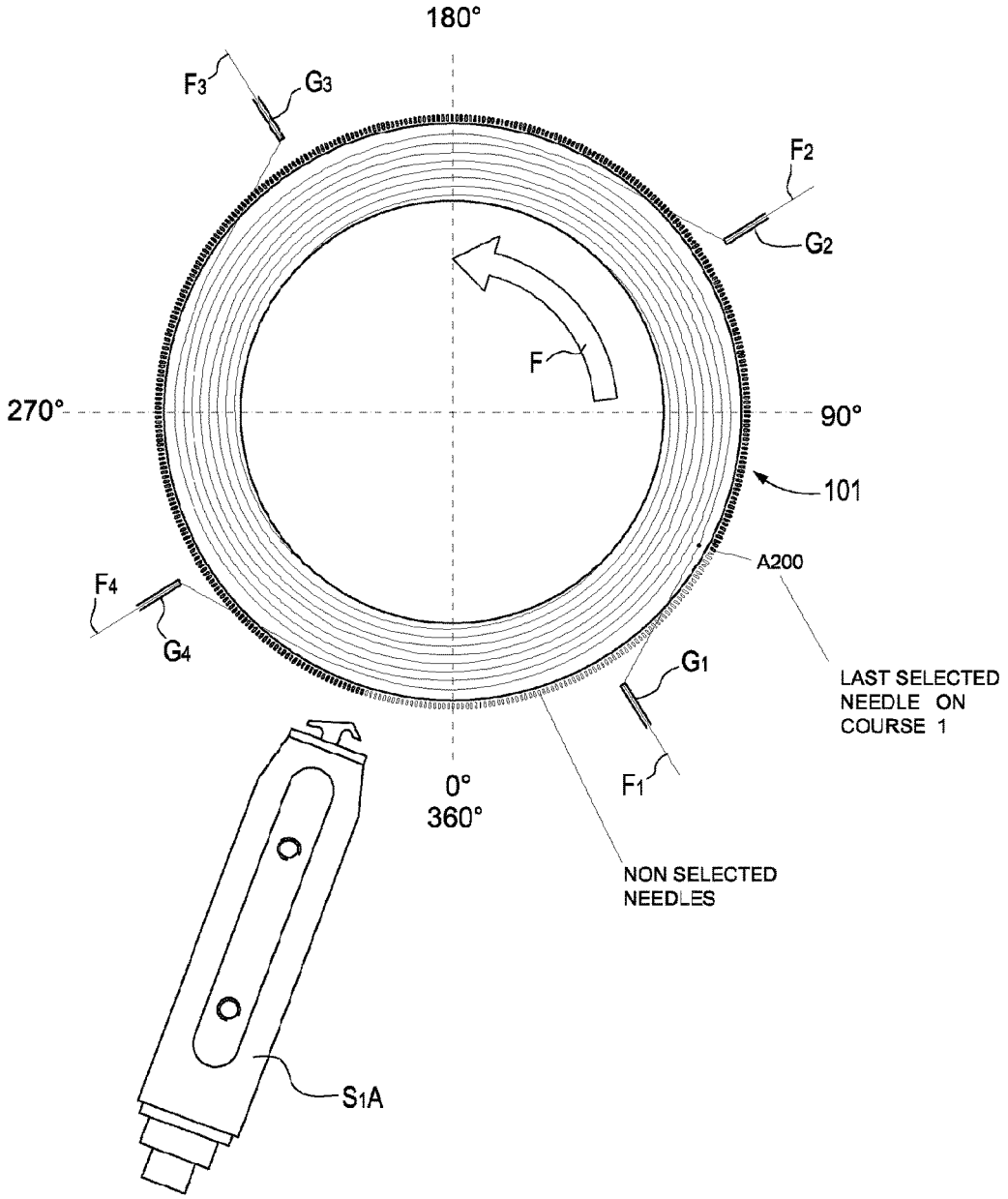

FIG. 5B in combination with FIG. 4 shows the step during which the first partial row formed with the yarn F1 and indicated with RxF1 in FIG. 4, of the portion 17D of the pocket 17 has been completely knitted. The needle cylinder 101 is rotating in counterclockwise direction (arrow F). The selector S1A, arranged upstream of the feed G1, has brought out of work the needles following the needle A200. The needle A200 forms the last stitch of the row RxF1, while the needle A201 and the following needles, not selected by the selector S1A, pass in front of the feed G1 without forming stitch.

Figure 5C:
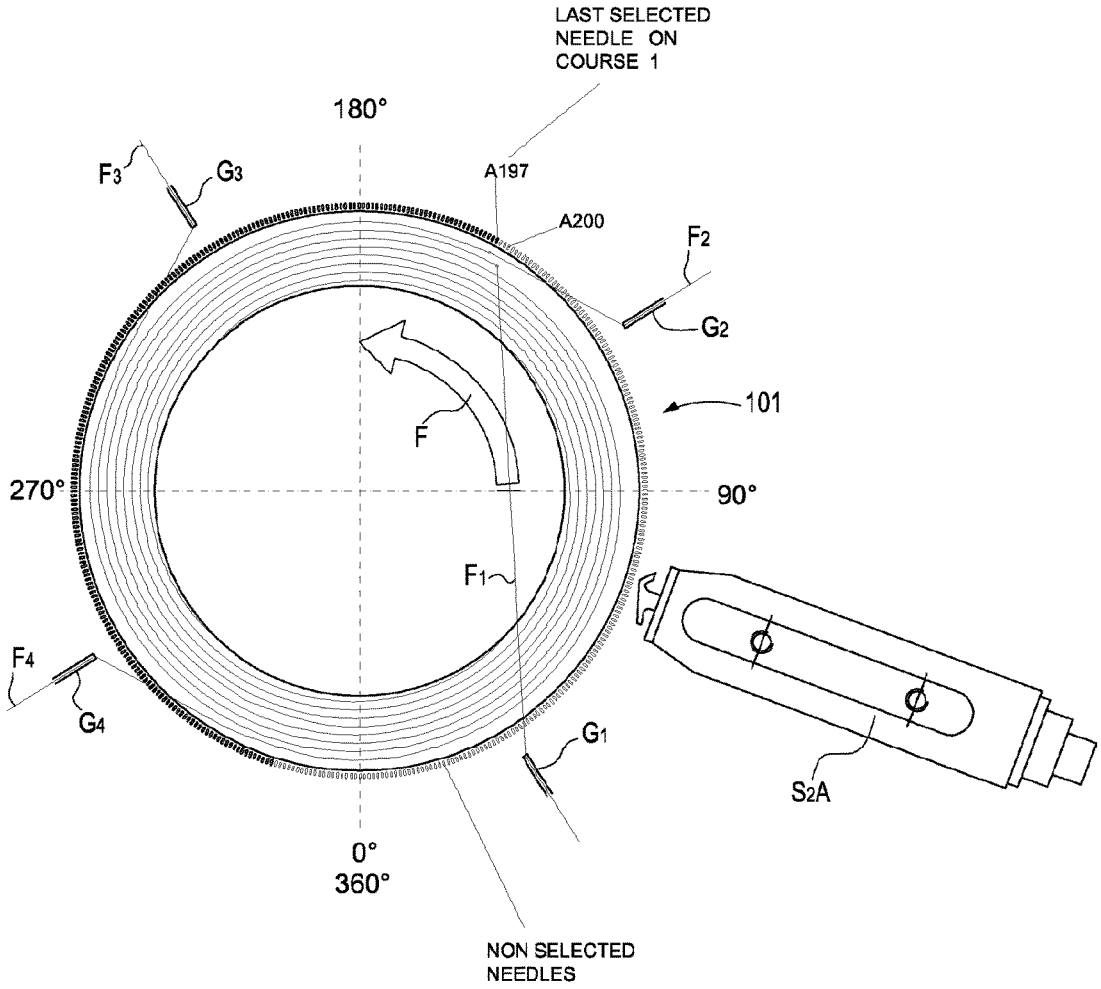

With reference to FIG. 5C in combination with FIG. 4, the cylinder 101 continues to rotate counterclockwise, so that the needle A200 and the following needles pass in front of the selector S2A and in front of the second feed G2. The last needle selected by the selector S2A is the needle A197, forming, with the yarn F2 of the second feed G2, the last stitch of the subsequent partial row indicated with RxF2. The needles following the needle A197 have not been selected and therefore they do not form stitches with the yarn F2. The end of the partial row RxF2 is shifted by three stitches with respect to the end of the row RxF1 previously formed with the yarn F1.

Figure 5D:
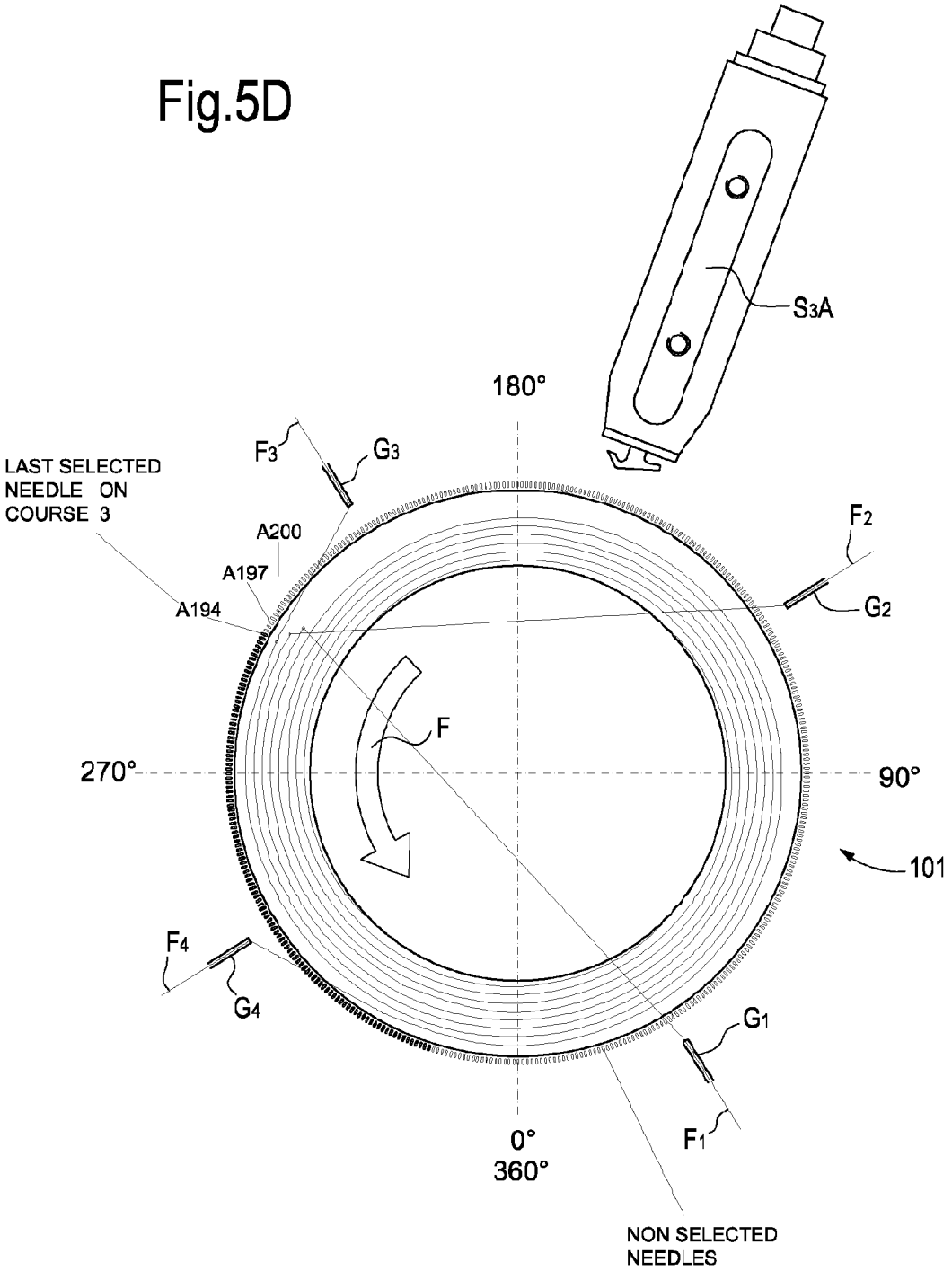

With reference to FIG. 5D in combination with FIG. 4, the needle cylinder 101 continues to rotate counterclockwise, bringing the needles A200-A197 firstly in front of the selector S3A associated with the third feed G3 and then in front of this latter. The selector S3A selects the needle A194 as last needle, and leave the following needles A195, A196, . . . inactive. The yarn F3 fed from the third feed G3 therefore stops forming stitches in correspondence of the needle A194, so that the partial row formed with the yarn F3 and indicated with RxF3 in FIG. 4 is shifted by three stitches with respect to the previous row RxF2 formed with the yarn F2 and is shifted by six stitches with respect to the row RxF1 formed with the yarn F1.

Figure 5E:
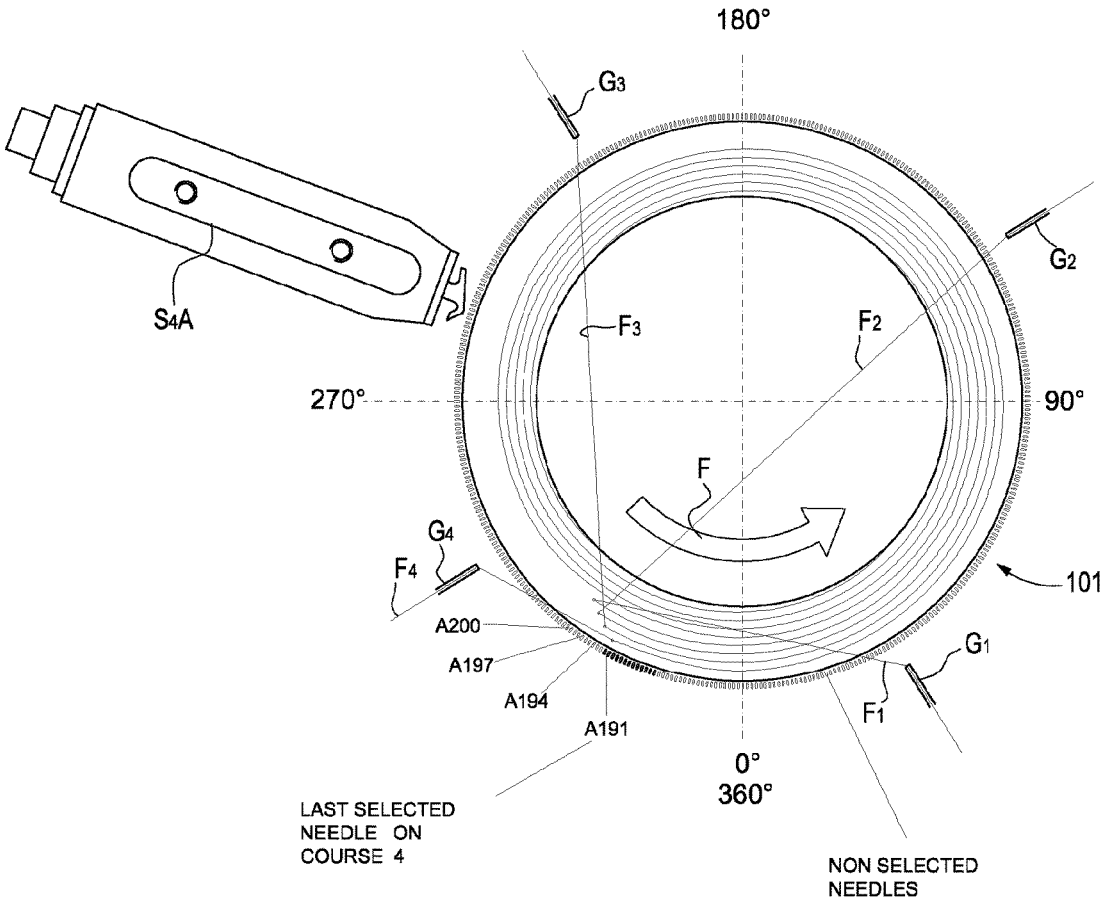
Figure 5F:
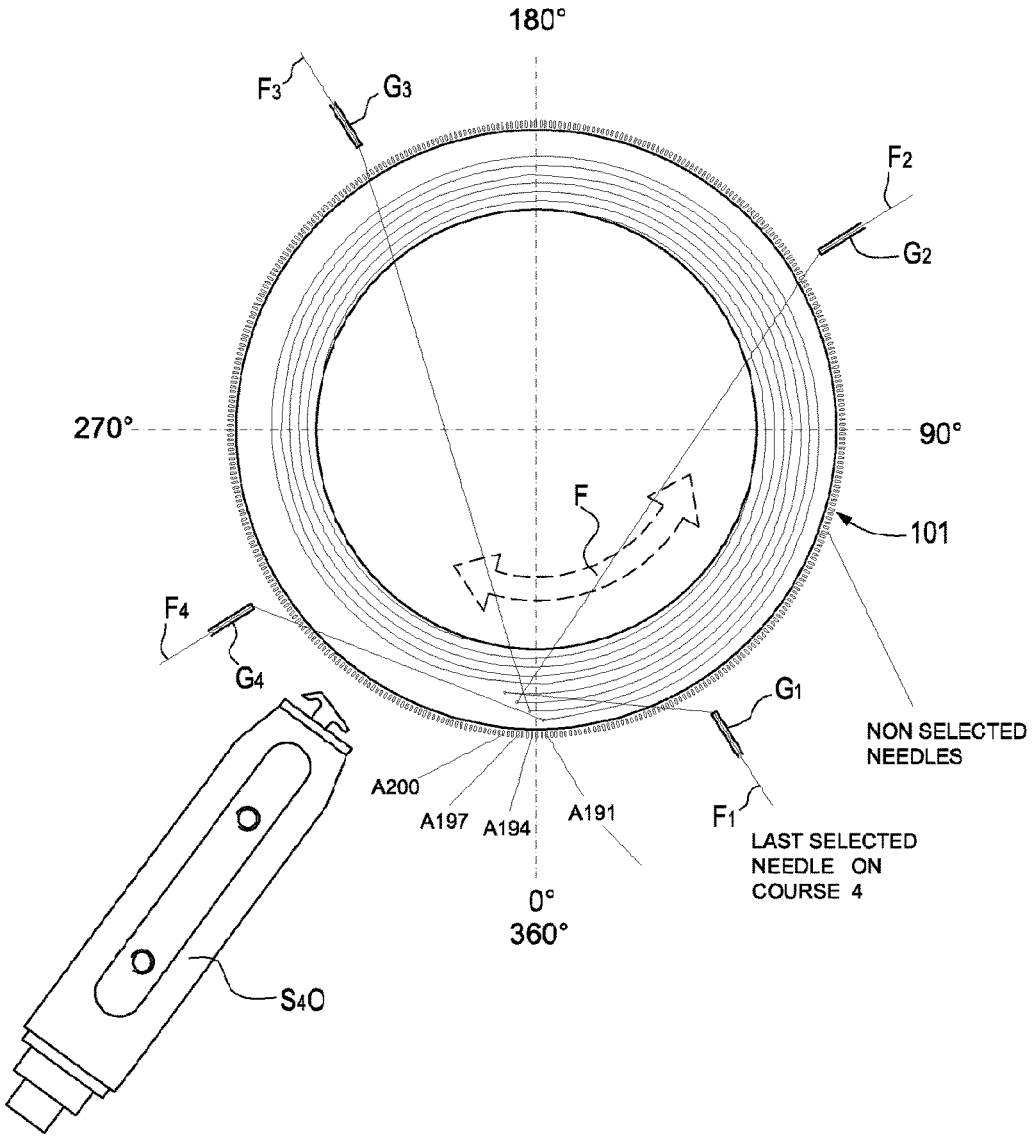

With reference to FIG. 5E in combination with FIG. 4, the needle cylinder 101 continues to rotate counterclockwise up to bring the needles A220. A199 . . . in front of the selector S4A and then in front of the fourth feed G4. The selector S4A selects the needle A191 as last needle, and leave the subsequent needles lowered. The yarn F4 from the fourth feed forms therefore a first partial row RxF4 that is shifted by three stitches with respect to the row RxF3, by six stitches with respect to the row RxF2 and by nine stitches with respect to the row RxF1.

FIG. 5 shows the angular position where the motion of the needle cylinder 101 is reversed (see the double arrow F). This occurs once the needles A200, A197, A194 and A191, holding the end stitches of the partial rows RxF1, RxF2, RxF3, and RxF4, have largely moved (nearly 30 degrees) beyond the position of the selector S4A.

When the continuous motion of the needle cylinder 101 in counterclockwise direction is finished, four partial rows have been therefore formed, ending with respective last stitches formed by means of the needles A200 (for the yarn F1 of the first feed), A197 (for the yarn F2 of the second feed), A194 (for the yarn F3 of the third feed), and A191 (for the yarn F4 of the fourth feed). These shifted ends of the four rows RxF1-RxF4 are arranged along the line L17 (FIGS. 2, 3). The ends of these partial rows are shifted with respect to one another by three needles, and therefore by three stitches, just by way of example. It should be understood that there can be more than three stitches, for instance from 5 to 9 stitches, between the end of a partial row and the end of the subsequent partial row.

Figure 5G:
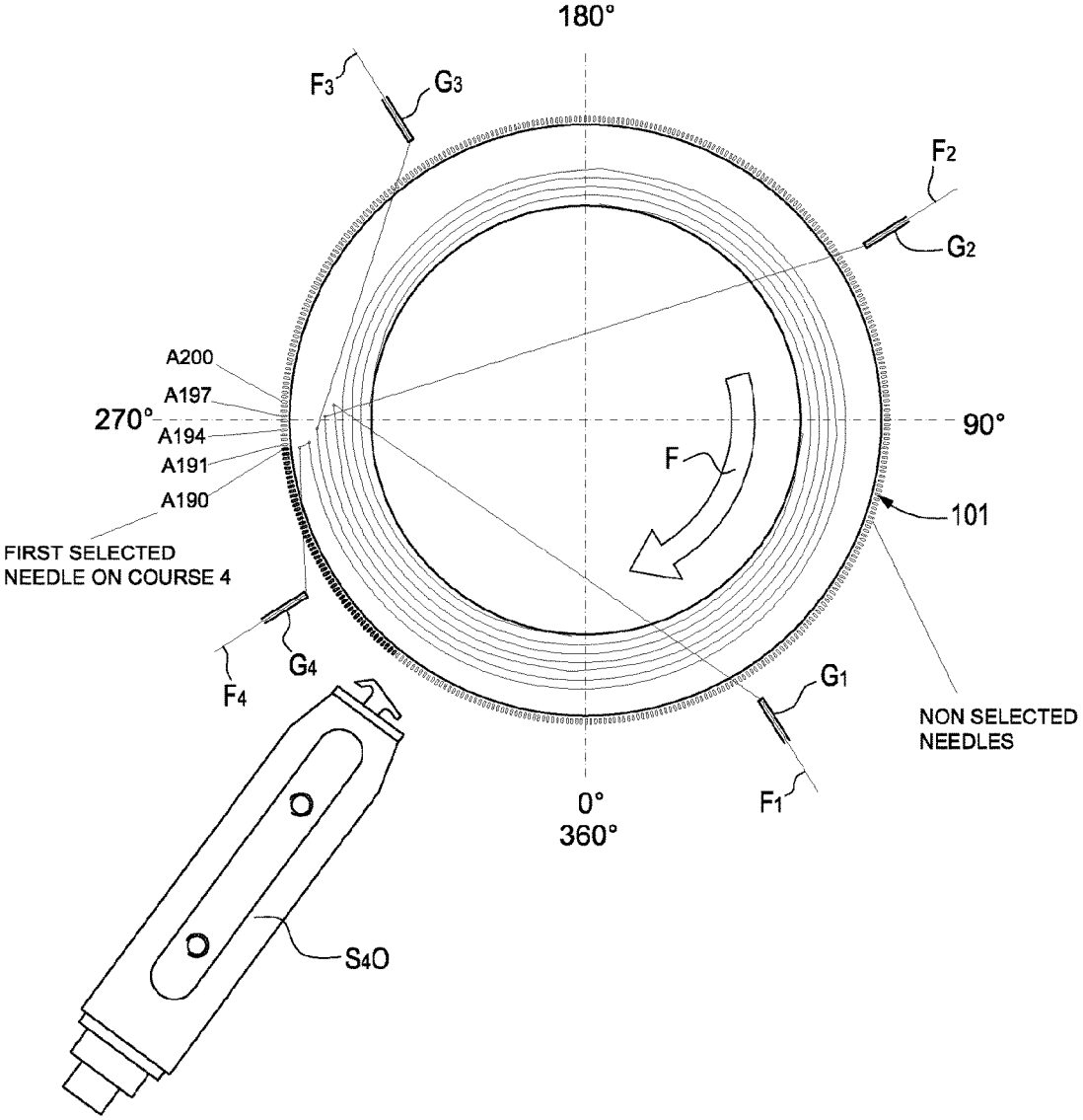

With reference to FIG. 5G in combination with FIG. 4, the subsequent step of the method for forming the pocket 17 of fabric is now described, wherein the needle cylinder 101 has reversed the rotation and starts to rotate clockwise (arrow F of FIG. 5G). The selector S4O associated with the fourth feed G4 selects the needle A190 as the first needle, and the following needles in the direction of rotation (i.e. the needles A189, A188, . . . ), and leaves the other needles A191, A192 . . . etc. inactive. So the formation of the following row with the yarn F4 begins. This row is indicated in FIG. 4 with RF4.

Figure 5H:
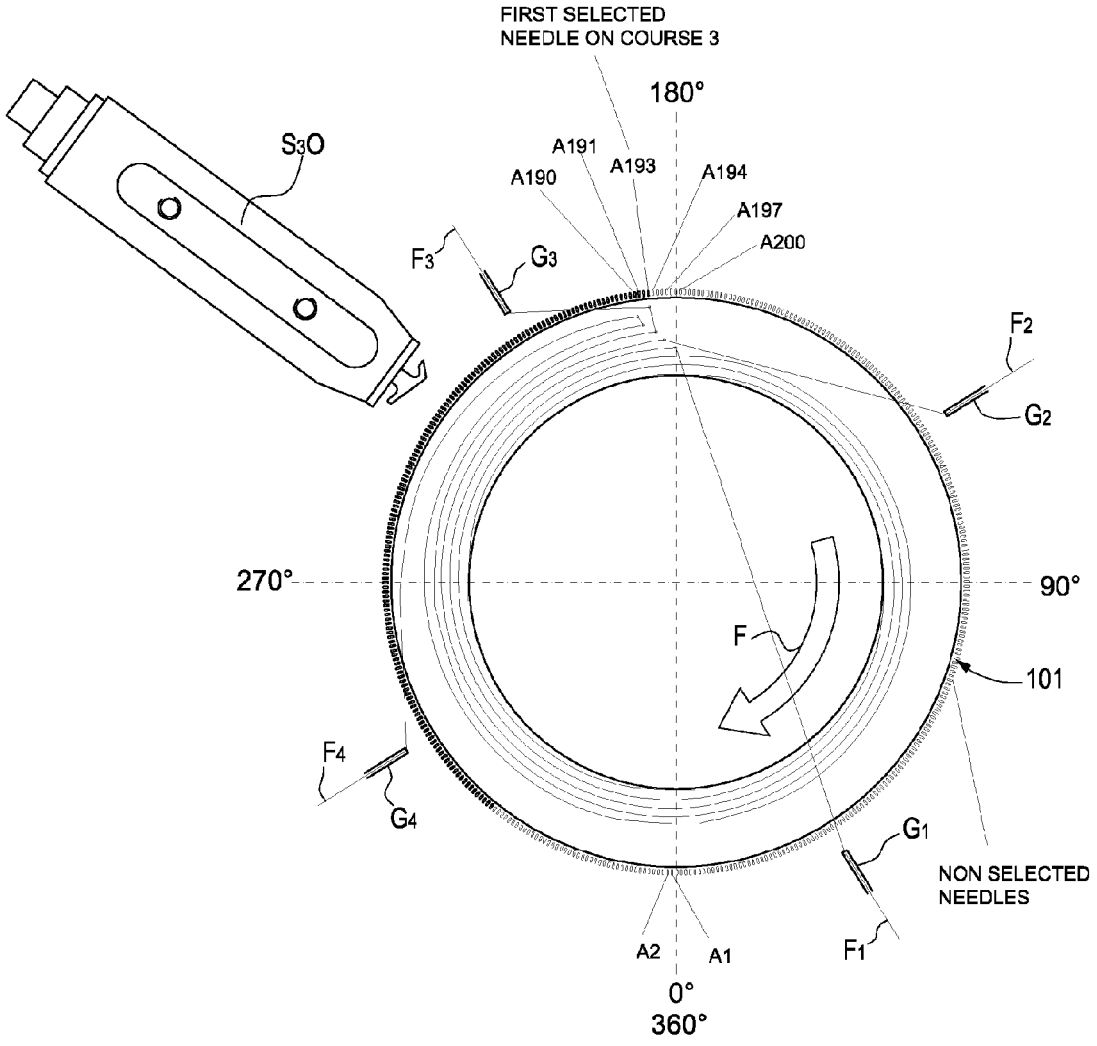

With reference to FIG. 5H in combination with FIG. 4, while the needle cylinder 101 continues to rotate in clockwise direction, the selector S3O begins to select the needles forming the row of stitches with the yarn F3 of the third feed G3. The first selected needle is the needle A193. The previous needles (A194, A195 . . . ) are inactive, while the following needles A192, A191, A190 form the subsequent stitches of the row being formed with the yarn F3, indicated with RF3 in FIG. 4.

Figure 5I:
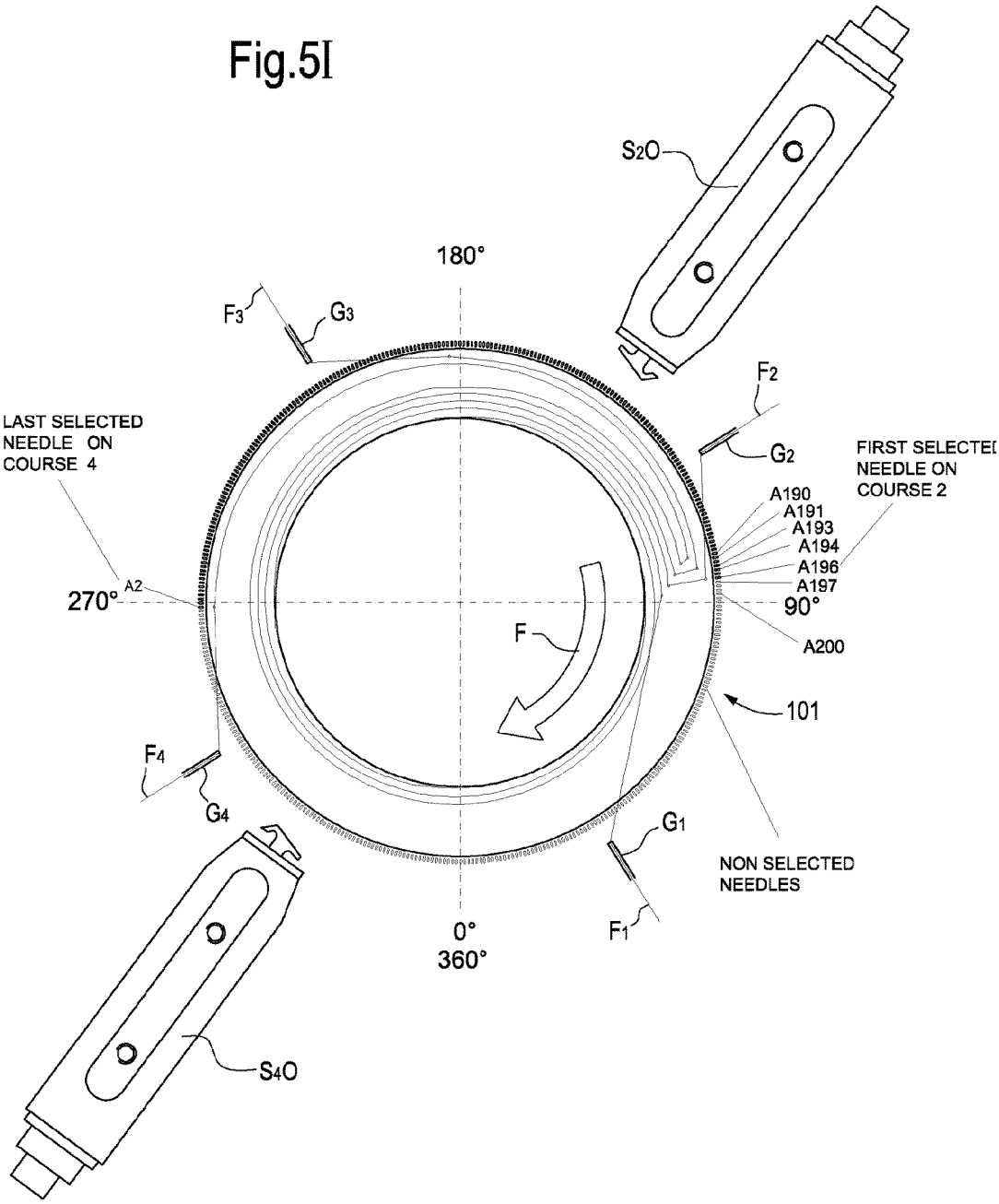

With reference to FIG. 5I in combination with FIG. 4, while the needle cylinder 101 continues to rotate clockwise the selector S2O, associated with the second feed G2 and arranged upstream of this feed with respect to the clockwise direction, selects the needle A196 as the first needle, leaving the previous needles (A197, A198, A199 . . . ) inactive and selecting the following needles (A195, A194 . . . ), so as to start the formation of the row RF2 with the yarn F2 of the second feed. At the same time, the selector S4O associated with the fourth feed G4 selects the last needle (A2) to end the formation of the partial row RF4 with the yarn F4 of the fourth feed. The following needles (A1, A400 . . . ) pass in front of the fourth feed without forming stitches. Therefore, the partial row RF4 extends from the stitch formed by means of the needle A197 up to the stitch formed by means of the needle A2.

Figure 5J:
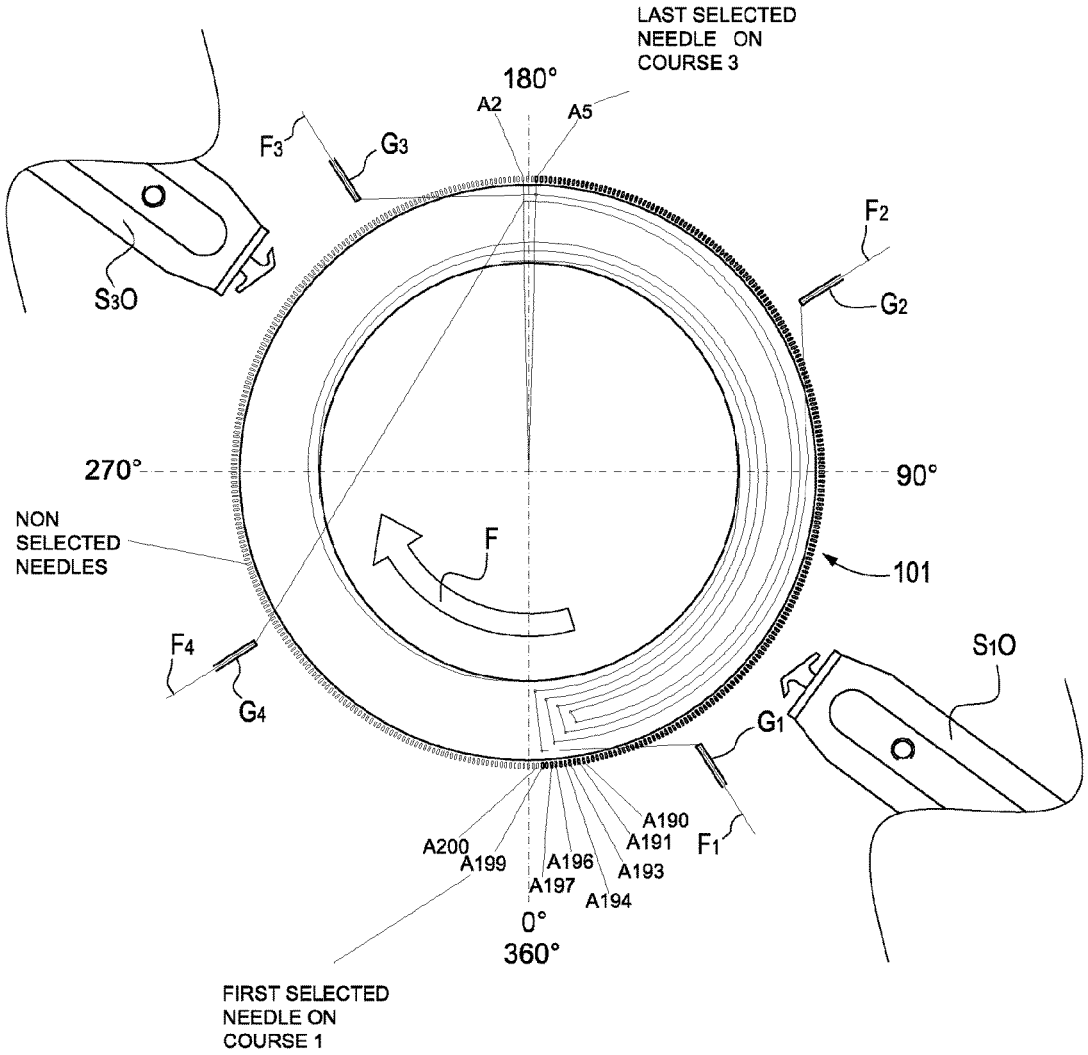

With reference to FIG. 5J in combination with FIG. 4, while the needle cylinder 101 continues to rotate clockwise, the selector S1O, associated with the first feed G1 and arranged upstream of this feed with respect to the clockwise direction, selects the needles for forming stitches with the yarn F1 of the first feed, producing the partial row RF1. The first selected needle is A199, while the previous needles (A200, A201 . . . ) are inactive. With reference to FIG. 5J again, the selector S3O associated with the third feed lowers the needles following the needle A5, so that the partial row RF3 formed with the yarn F3 of the third feed ends with the stitch formed by means of the needle A5 and is therefore formed by the stitches created by the needles A193, A192, A191 . . . A5.

Figure 5K:
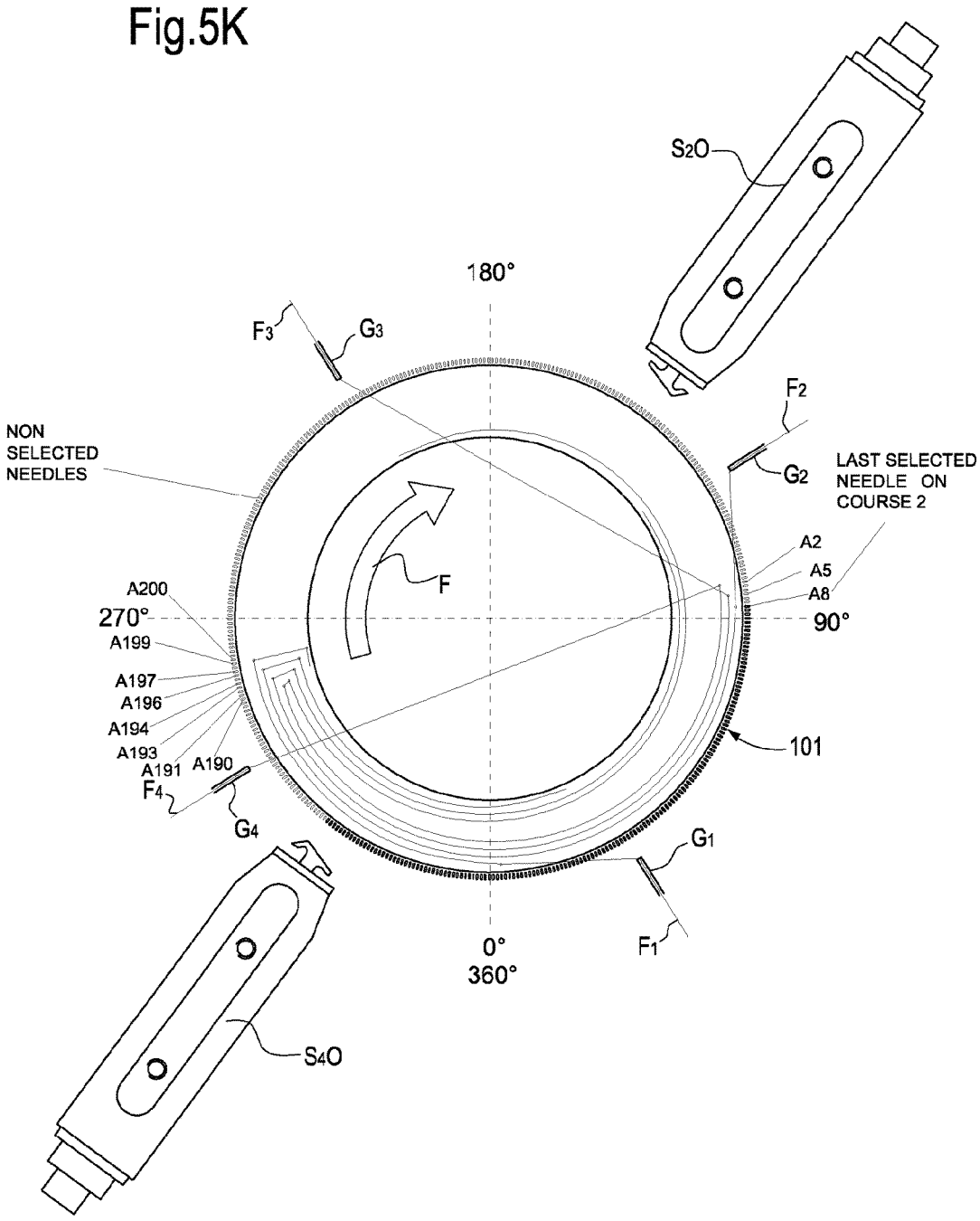

The needle cylinder 101 continues to rotate clockwise, as shown in FIG. 5K. In this figure the selector S2O associated with the second feed G2 has selected the needle A8 as last needle for forming the last stitch of the row RF2, while the needles A7, A6 and the following are inactive. The partial row RF2 formed with the yarn F2 is therefore comprised of the stitches formed by means of the needles A8, A9, A10 . . . A195. The selector S4O does not select any needle.

Figure 5L:
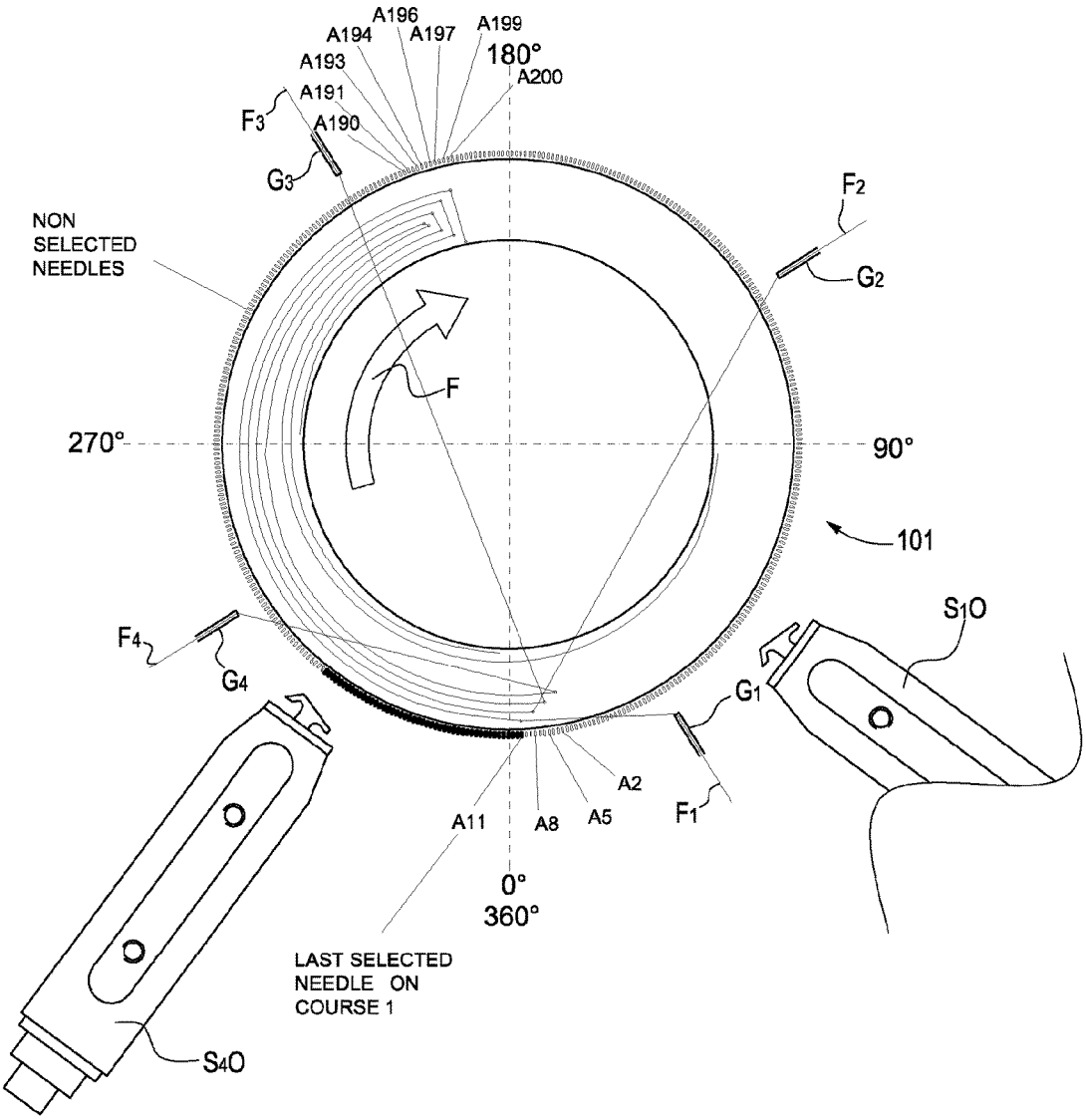

The needle cylinder 101 continues to rotate clockwise until the partial row RF1 has been completely formed, as shown in FIG. 5L in combination with FIG. 4. All is the last needle selected by the selector S1O for forming the partial row RF1. The following needles A10, A9, A8 . . . are lowered and do not form stitches. The partial row RF1 (FIG. 4) is therefore comprised of the stitches formed by means of the needles A199, A198, A197, . . . A11.

Figure 5M:
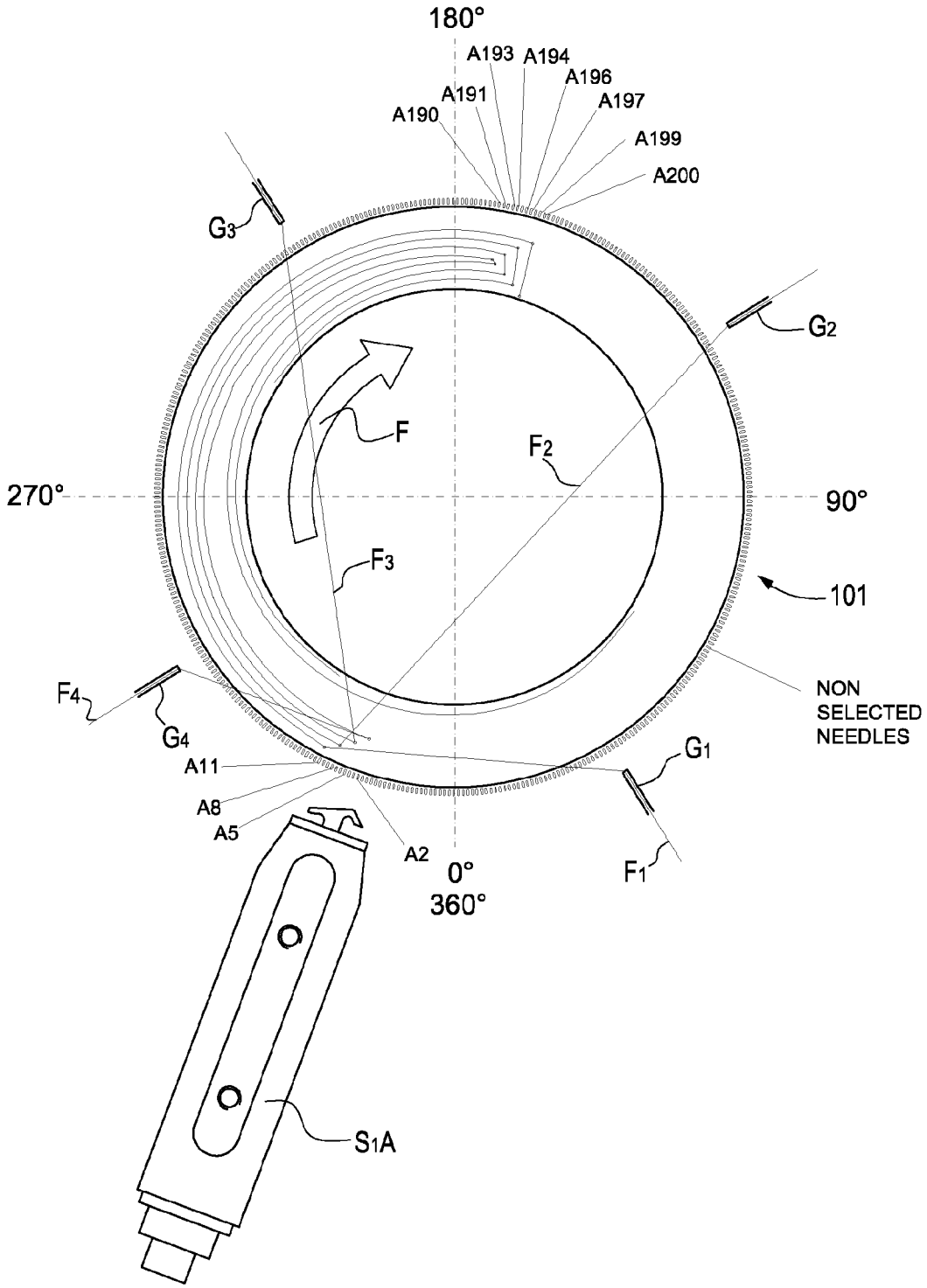

The needle cylinder 101 continues to rotate clockwise up to the position shown in FIG. 5M, i.e. until the last needles selected by the selector S1O have passed beyond the following selector S1A. In this way, when the rotation of the needle cylinder 101 is reversed again, the selector S1A can correctly select the needles for forming the subsequent partial rows.

The result of this process is shown clearly in FIG. 4. The last partial rows RxF1, RxF2, RxF3, RxF4, formed during the last counterclockwise rotation of the needle cylinder with continuous motion, end in shifted points, i.e. the last stitch formed in each of these rows is shifted with respect to the last stitches of the adjacent partial rows. The row RxF1 formed with the yarn F1 of the first feed G1 ends with the stitch formed by means of the needle A200. The row RxF2 formed with the yarn F2 of the second feed G2 ends with the stitch formed by means of the needle A197. The row RxF3 formed with the yarn F3 of the third feed G3 ends with the stitch formed by means of the needle A194. Lastly, the row RxF4 formed with the yarn F4 of the fourth feed G43 ends with the stitch formed by means of the needle A191. The end stitches of each row are therefore shifted with respect to one another by three stitches (in this example of embodiment). The first series of partial rows is formed by reducing the length of each row by two stitches, one stitch at each end of the respective row. For instance, the yarn F1 of the first feed, which has formed the last stitch with the needle A200, starts to knit the following row RF1 with the needle A199. Moreover, the partial rows RF4, RF3, RF2, RF1 start at points shifted with respect to one another by three stitches and, similarly, terminate shifted with respect to one another by the same number of stitches, so that each of these rows is formed by an equal number of stitches:

the row RF4 is formed by the stitches formed by the needles A190 up to A2;

the row RF3 is formed by the stitches formed by the needles A193 up to A5;

the row RF2 is formed by the stitches formed by the needles A196 up to A8;

the row RF1 is formed by the stitches formed by the needles A199 up to A11.

However, the end stitches of the various partial rows formed with the different feeds during an angular stroke, i.e. during an oscillation or reciprocating stroke of the rotary motion of the needle cylinder 101, are not aligned on the same column of stitches, but they are shifted.

In other embodiments each row formed by a yarn can be reduced, at both ends thereof, by more than one stitch with respect to the previous row.

Still referring to FIG. 6, it can be clearly understood that during knitting of the second part of each pocket of fabric the length of partial rows is gradually increased upon each reversal of the needle cylinder motion. In the embodiment shown such increase is performed at each reversal, so that each row grows at both ends thereof. In the exemplary embodiment, growth of length of the rows is by one stitch at each end of the row, i.e. each row of increasing length has an additional stitch at both ends thereof with respect to the previous (shorter) row. It shall be understood that the number of increasing stitches can be different than one per terminal end (i.e. more than two per row).

When the knitting motion starts again in counterclockwise direction, starting from the position shown in FIG. 5M, the first feed G1 begins to form stitches with the needle adjacent to the needle that has formed the last stitch of the partial row RF1; therefore, the first stitch of the following row formed with the yarn F1 is the stitch formed by the needle A12. The row in question is indicated with RF1' in FIG. 4. This row extends up to the stitch formed by means of the needle A198 and is therefore decreased by two stitches (it is therefore shorter by two stitches) with respect to the previous partial row RF1 formed with the yarn F1 of the first feed G1.

Similarly, the yarn F2 of the second feed begins to form stitches starting from the needle A9, adjacent to the needle A8 that has formed the last stitch in the previous clockwise movement, and ends the formation of the partial row RF2' with the stitch formed by means of the needle ago A195, being thus shorter by two stitches with respect to the row RF2 previously formed with the same feed. The two rows RF1', RF2' are shifted with respect to each other by three stitches (the row RF1' starts from the needle A12 and ends at the needle A198, while the row RF2' starts from the needle A9 and ends at the needle A195).

As it is shown in FIG. 4, the knitting process continues with the knitting of sets of four partial rows of decreasing length, so that the four rows formed at every oscillation or reciprocating stroke of the needle cylinder 101 are shifted by three stitches with respect to one another.

In the described embodiment, the needles are selected so that the rows formed with the four feeds are shifted by three stitches with respect to one another in an ordered manner, i.e. for instance the start ends of the rows RF1-RF4 are shifted three by three, starting from the row formed with the first feed (yarn F1) up to the row formed with the fourth feed (yarn F4). At the opposite end, the start points of the rows RF1'-RF4' are shifted reversely, starting from the first stitch formed with the yarn F4 up to the first stitch formed with the yarn F1. However, this is not strictly necessary; in some cases the sequences can be modified, as it will be clearly apparent below.

As a result of the described knitting process, along the lines L17 of the pocket 17 of fabric the ends of the partial rows R17 (that in the detail of FIG. 4 are the single rows RF1-RF4, RF1'-RF4' and following) do not coincide; they are instead distributed on a band of stitches, thus resulting in am ore uniform fabric with a lower concentration of tensile stresses on the single yarns.

Once the decreasing partial rows forming the portion 17D of the pocket 17 have been knitted, the process continues forming partial rows of gradually increasing length, as shown in FIG. 4, for forming the portion 17C of fabric. The process is substantially symmetrical to that described for forming the partial rows of decreasing length. Also the partial rows of gradually increasing length formed with the four feeds at every angular stroke of the needle cylinder 101 in one direction or in the opposite direction are shifted by three stitches with respect to one another, as described above with reference to the formation of the portion 17D. Each row formed with the yarn from a given feed increases by two stitches with respect to the previous row formed with the same feed. The length of the partial rows forming the portion 17C of fabric increases up to a length equal to 190 stitches. The four rows having a length of 190 stitches are the rows corresponding to the line 25 of FIG. 1.

For the sake of clarity, the sequences of FIGS. 6A-6F show six subsequent steps of forming the partial rows of increasing length. In each step four rows are knitted with the yarns F1-F4 from the four feeds G1-G4.

Figure 6A:
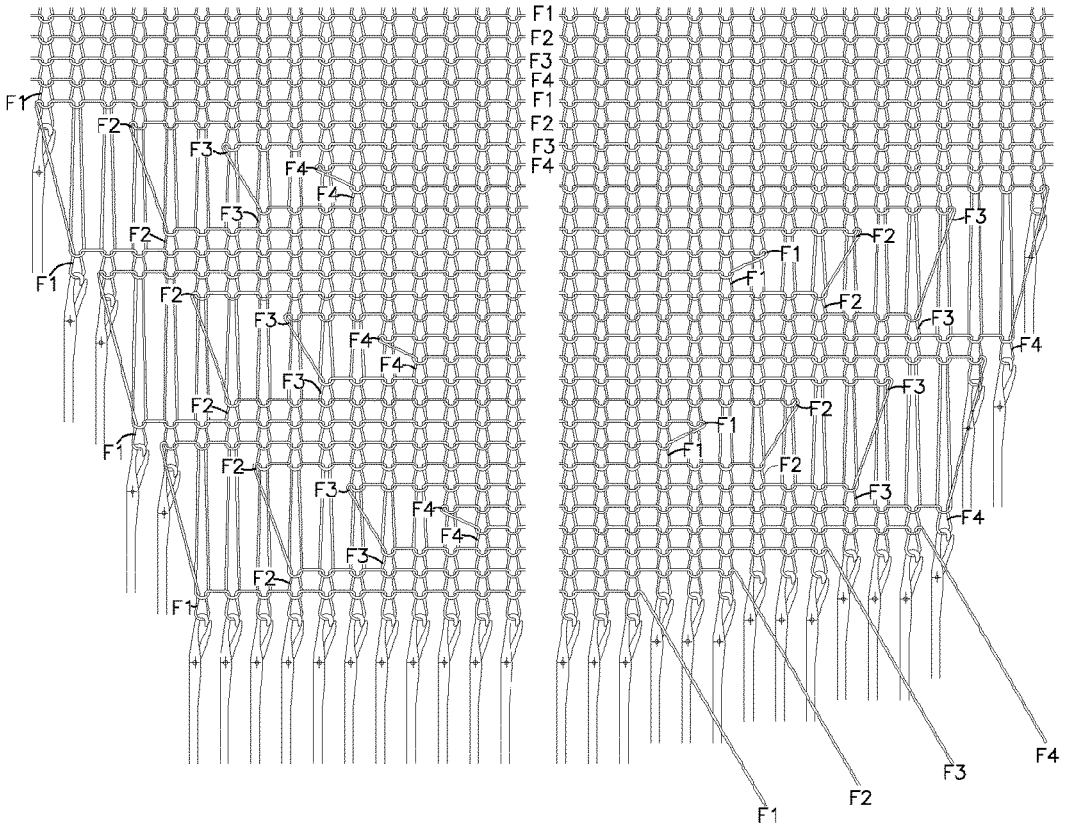
FIGS. 6A-6F show a schematic enlargement similar to that of FIG. 4, with a sequence of formation of increasing partial rows in the area of a pocket of fabric of the body.

More in particular, FIG. 6A shows the formation of the last series of four decreasing rows formed with the yarns F4, F3, F2, F1. In this example the last movement of the needle cylinder is in clockwise direction.

Figure 6B:
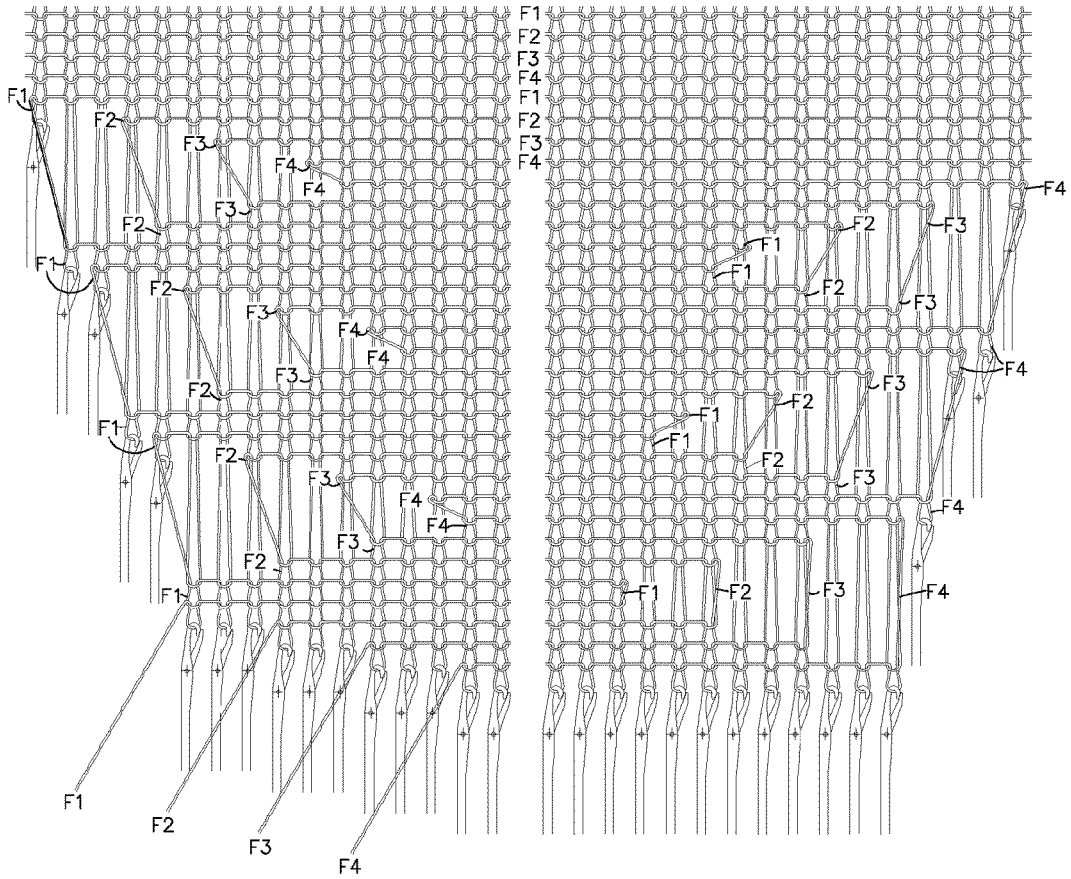

FIG. 6B shows the end of the subsequent reciprocating motion in counterclockwise direction, when there is the formation of the first series of four rows (formed with the yarns F1, F2, F3, F4 in sequence) of the portion 17C of fabric with rows of increasing length.

Figure 6C:
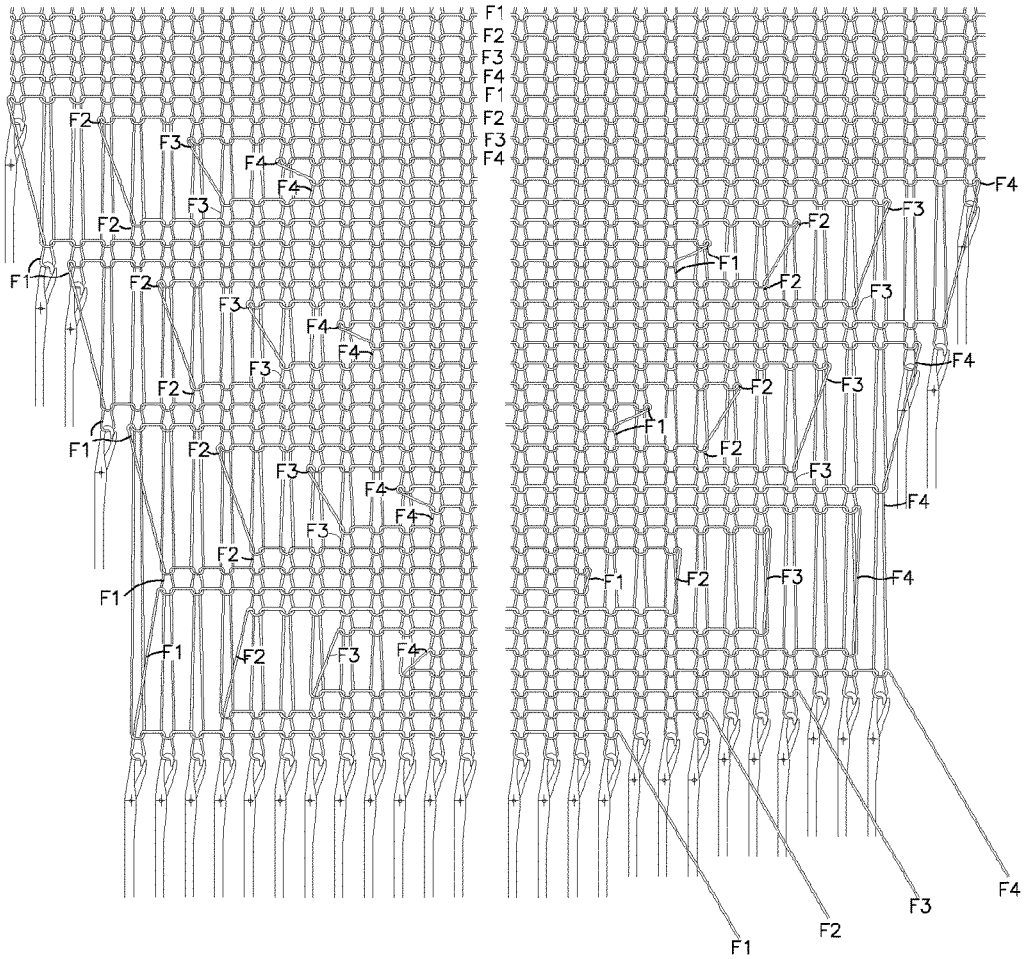
Figure 6D:
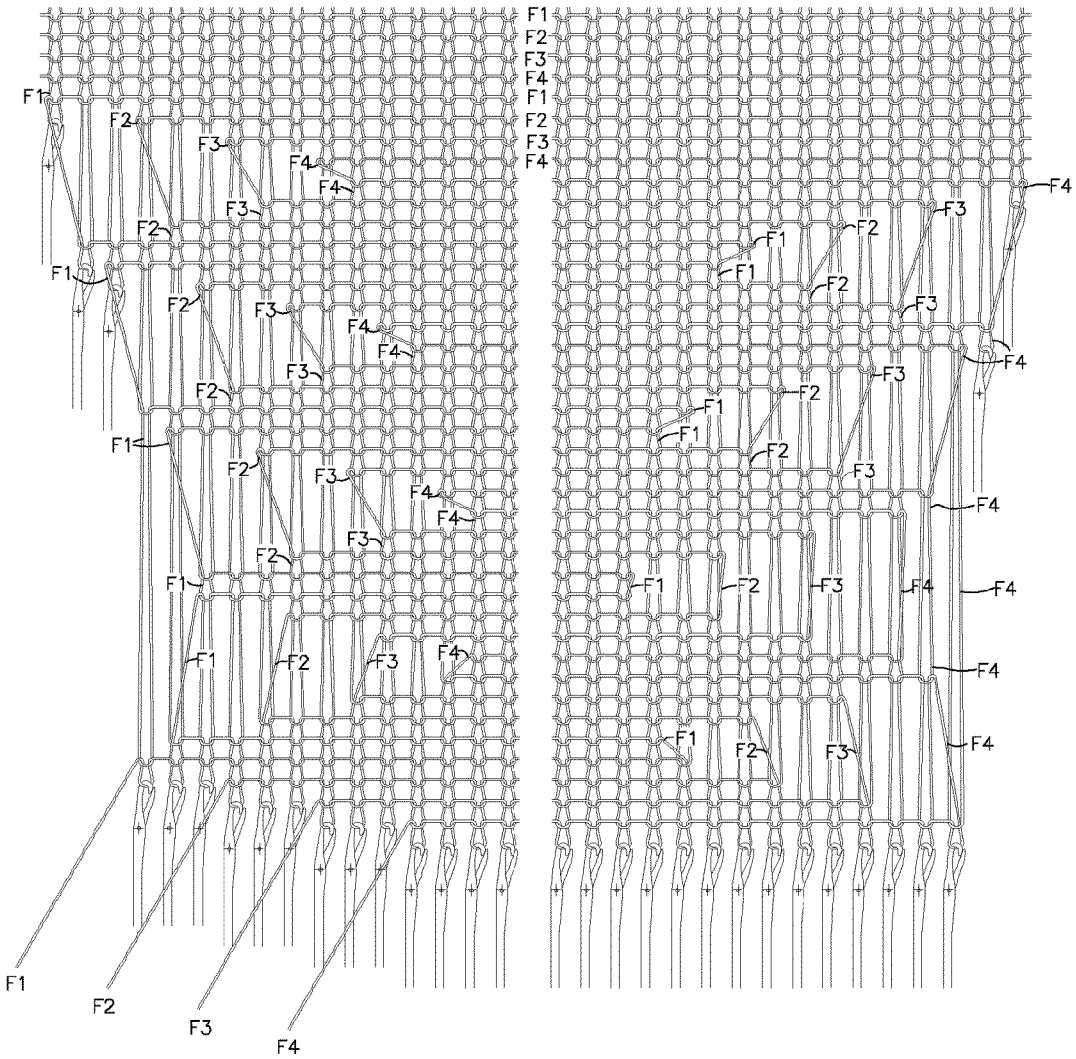
Figure 6E:
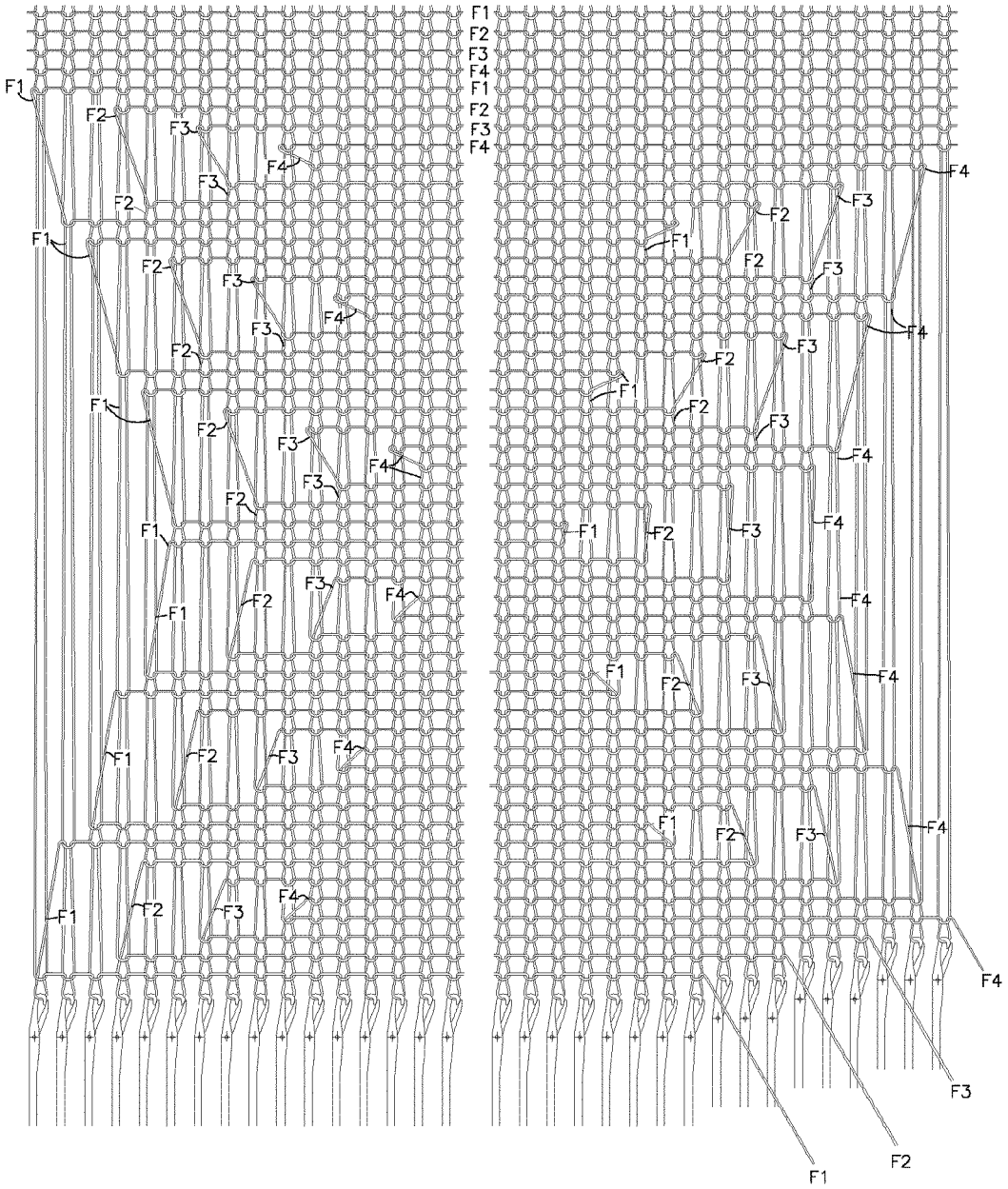
Figure 6F:
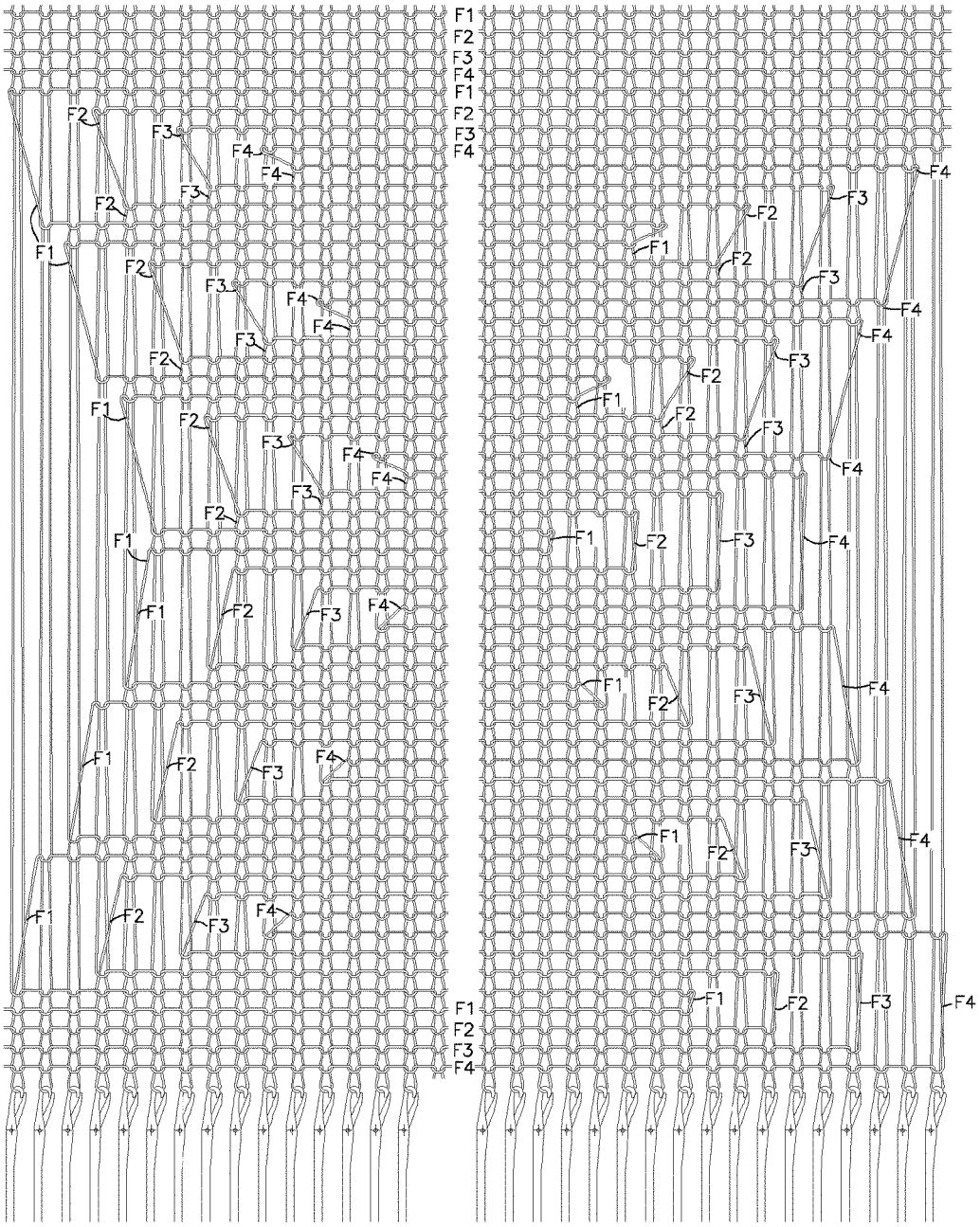

FIG. 6C shows the end of the subsequent reciprocating motion on clockwise direction, when there is the formation of a new series of rows with the yarns F4, F3, F2, F1, each row being two stitches longer with respect to the rows formed during the previous cycle. The subsequent FIGS. 6D-6F show how this process continues.

It should be understood that in the schematic example of FIGS. 4, 5A-5M, 6A-6F a reduced number of rows is shown, of decreasing and increasing length, as the shortest row is 195−15=180 stitches long. However, in the reality the number of decreasing rows is greater since, while the partial row of greater length are comprised for instance of 200 stitches, the rows of minimal length (rows RM17 in FIG. 3) have a length comprised for instance between 40 and 120 stitches, preferably between 70 and 90 stitches, for instance about 80 stitches. Obviously, these values and numbers are only non-limiting examples.

Once the last partial rows have been completed along the line 25, the needle cylinder 101 starts to rotate counterclockwise again for forming the central portion 15 of the body 7 with continuous motion. FIG. 4 schematically shows the decreased and increased rows forming the pocket 17 of fabric, between the last continuous rows of the leg piece 3 and the first continuous rows of the central portion 15 of the body 7.

Figure 7:
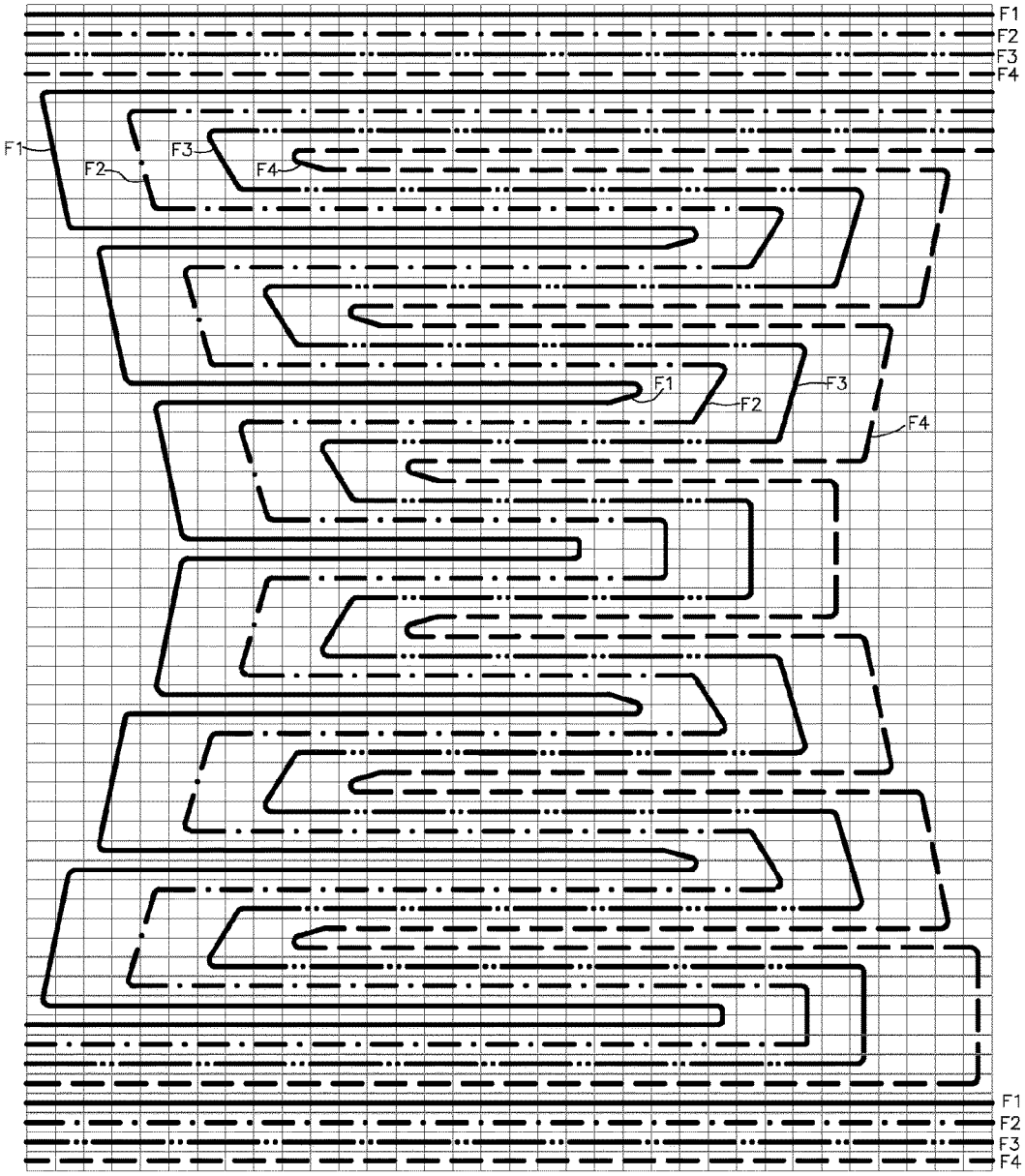
FIG. 7 schematically shows the arrangement of the rows of stitches formed with four feeds in the area where the pocket of fabric is formed.

FIG. 7 schematically shows the rows formed with the yarns F1-F4 according to the method described above. The rows formed by four yarns are indicated with four different types of lines.

The pocket 19 of fabric is made according to the same procedure described with reference to FIGS. 4, 5A-5M, 6A-6F, starting from the group of rows 27. Firstly, the decreasing partial rows are formed, starting from the rows Rx19 up to the rows RM19, forming the portion 19D of fabric. The partial rows formed in this step with reciprocating motion of the needle cylinder 101 have a gradually decreasing length from the maximum of 190 stitches up to the minimal length of the rows RM19. In the same manner as for the pocket 17, when forming the portion 19D of fabric every time the motion is reversed the rows decrease by two stitches with respect to the rows formed during the previous angular stroke. The four rows formed at every movement in clockwise and counterclockwise direction with the yarns from the four feeds are shifted with respect from one another; in the example illustrated they are shifted by three stitches.

Similarly to the portion 17C, the formation of the portion 19C of fabric starts with a gradual increase in the length of the rows, from the minimal length of the rows RM19 up to the maximum length of 190 stitches of the last four partial rows formed with the yarns from the four feeds during the last partial rotation of the reciprocating motion. Then, the knitting continues with continuous motion in counterclockwise direction to form the tubular fabric of the second leg piece 5.

With reference to FIGS. 4, 5A-5M, 6A-6F, 7 a knitting process has been described for knitting the pockets 17 and 19 of fabric, wherein the sequence of rows of each group of rows formed by the yarns F1-F4 from the various feeds with which the machine is provided is repeated at every reciprocating stroke in one direction symmetrically to the sequence of the rows created during the previous reciprocating stroke in the opposite direction. For instance, with reference to FIG. 4, the rows RxF1-RxF4 are formed by the following yarn sequence: F1, F2, F3, F4. The group of four following rows RF4-RF1 is formed by the sequence F4, F3, F2, F1. The group of subsequently following rows will be formed by the sequence F1, F2, F3, F4, and so on.

Figure 8:
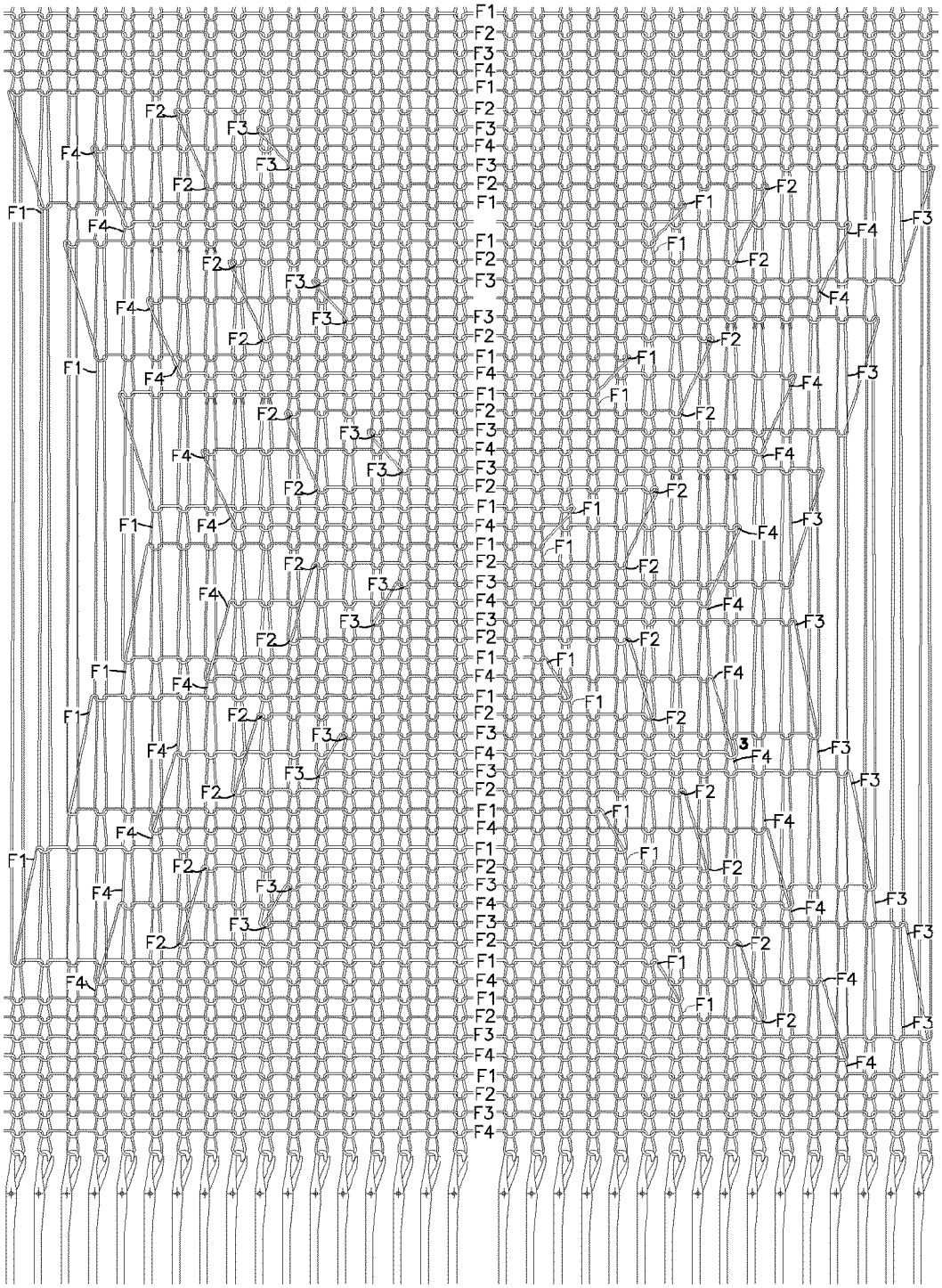
FIG. 8 shows a schematic enlargement similar to that of FIG. 4, in a further embodiment.

However, this particular reversed sequence is not strictly necessary, even if it is preferred, as it results in an easier movement of the yarns. FIG. 8 shows for instance rows formed with the yarns F1-F4 of the four feeds G1-G4 following one another according to the sequence below: F1, F2, F3, F4 for the last series of rows with continuous motion, then F3 F2 F1 F4 F1 F2 F3 F4 F3 F2 F1 F4 F1 F2 F3 F4 . . . etc. This sequence is particularly useful when Z-twist and S-twist yarns are used, i.e. elastomer yarns coated with an outer yarn helically wound around the elastomer core in clockwise or counterclockwise direction, respectively. The yarns F1 and F3 can be for instance Z-twist yarns, while the yarns F2 and F4 can be S-twist yarns. With the sequence defined above the S-twist yarns and the Z-twist yarns alternate with each other: each row made with an S-twist yarn is followed by a row made with a Z-twist yarn, and vice versa.

However, the partial rows of decreasing and increasing length are always shifted with respect to one another, as in the example of embodiment of FIG. 4.

Figure 9:
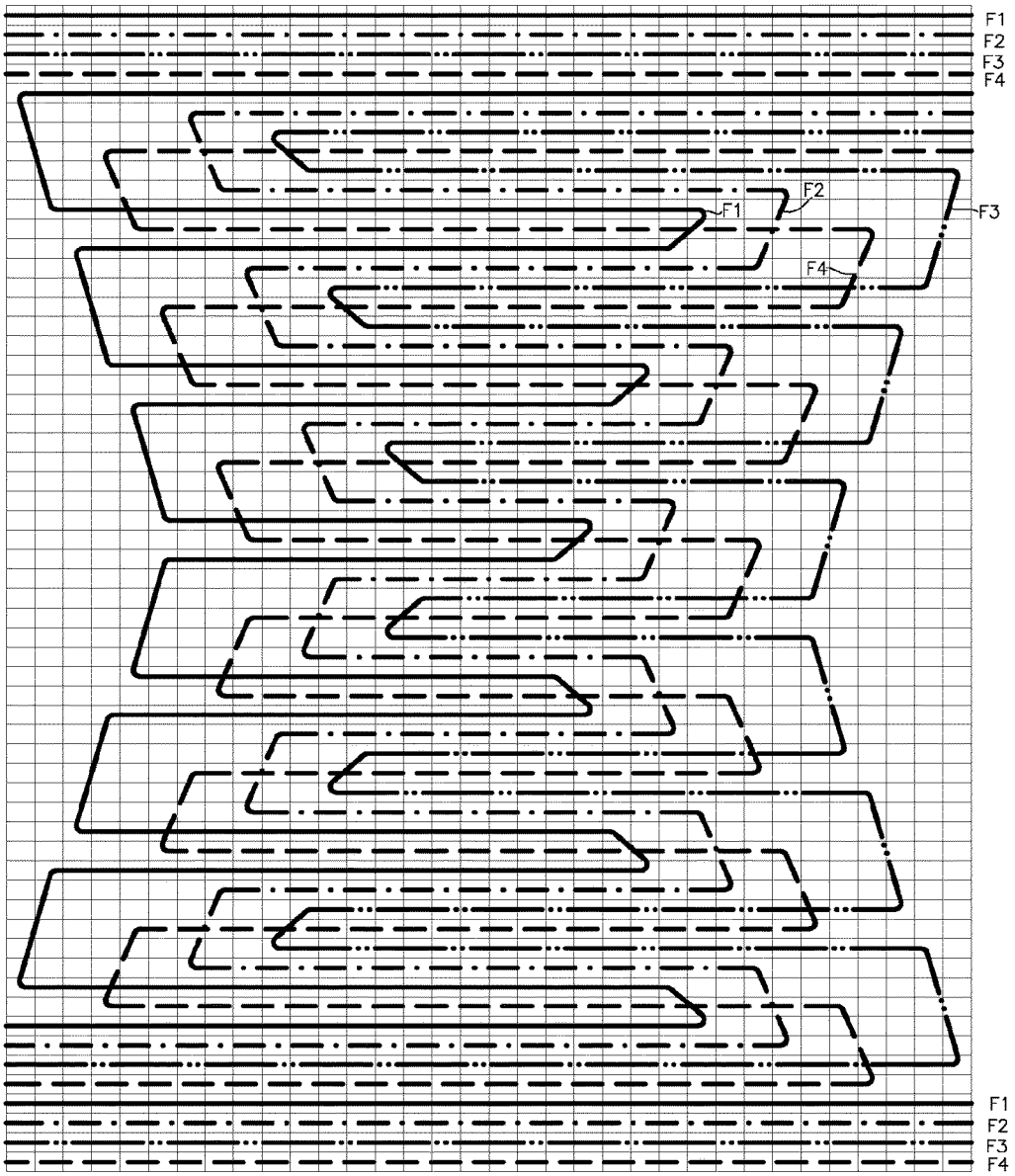
FIG. 9 shows, analogously to FIG. 7, the arrangement of the rows of stitches formed with four feeds in the area where the pocket of fabric is formed in the embodiment of FIG. 8.

Analogously to FIG. 7, FIG. 9 shows the rows formed with the four yarns F1, F2, F3, F4 in the embodiment of FIG. 8.

Figure 10A:
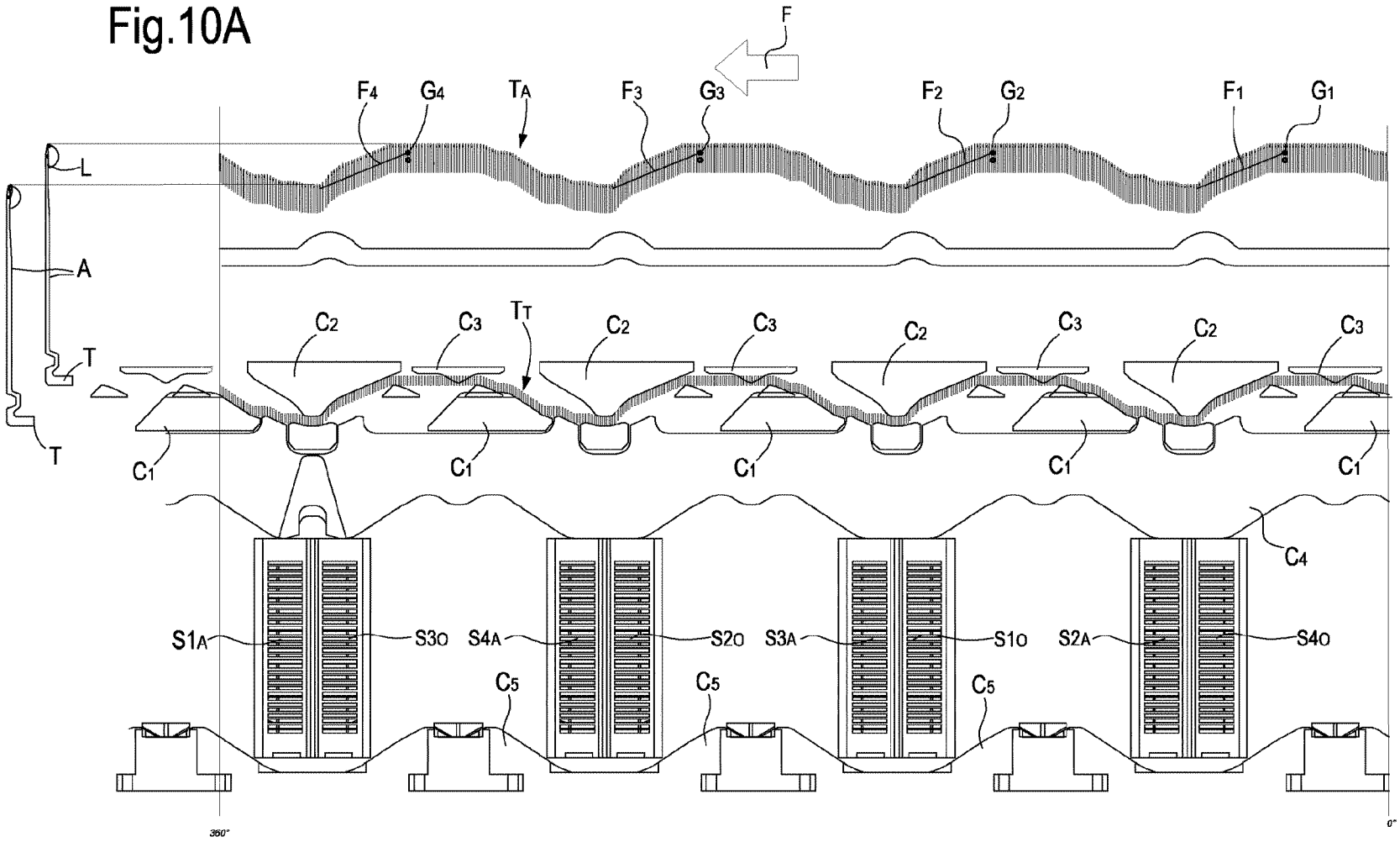
FIGS. 10A-10C show an extension of the cam mantle and the selectors and their operation while knitting with continuous motion and with reciprocating motion in counter-clockwise and clockwise direction of rotation.
Figure 10B:
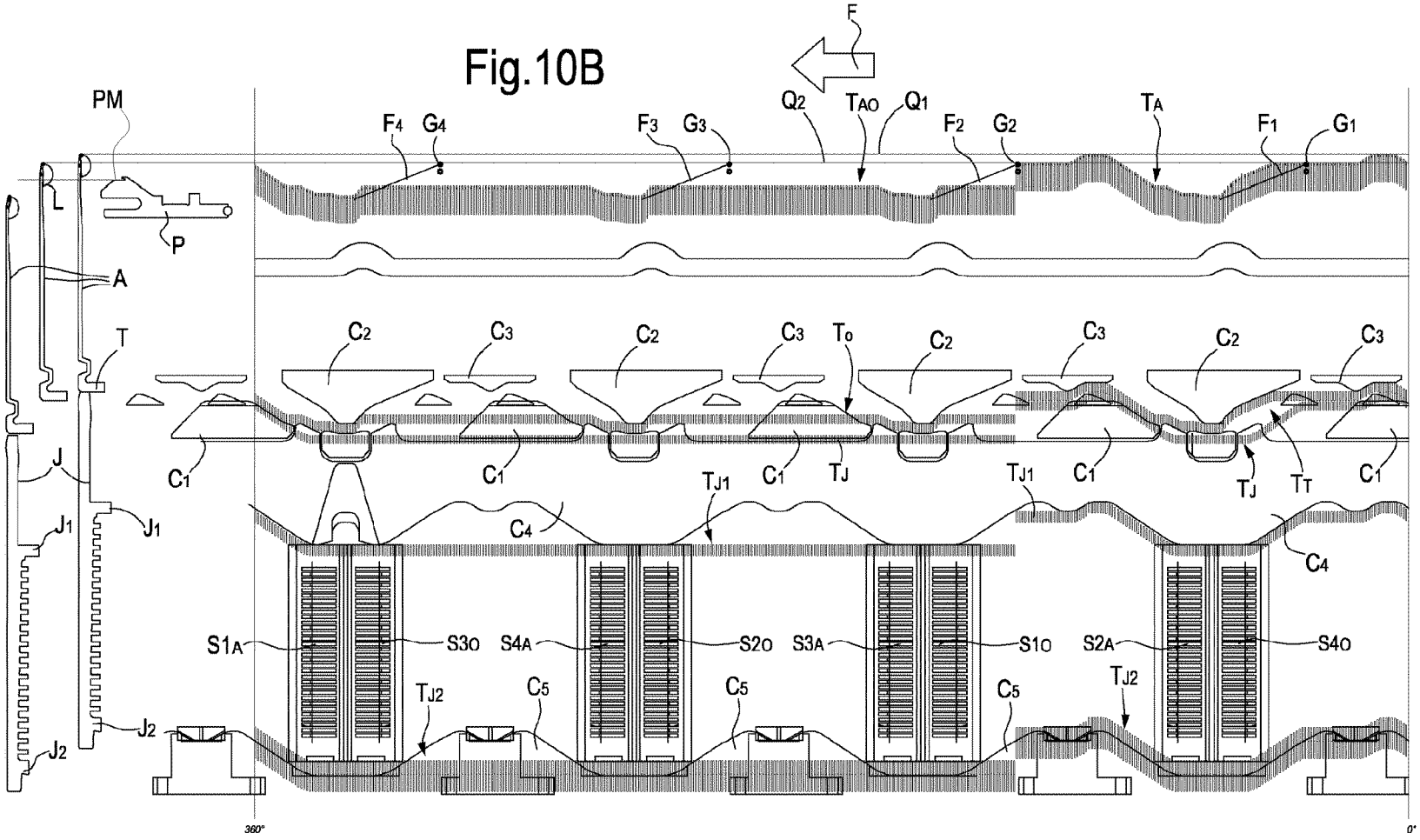
Figure 10C:
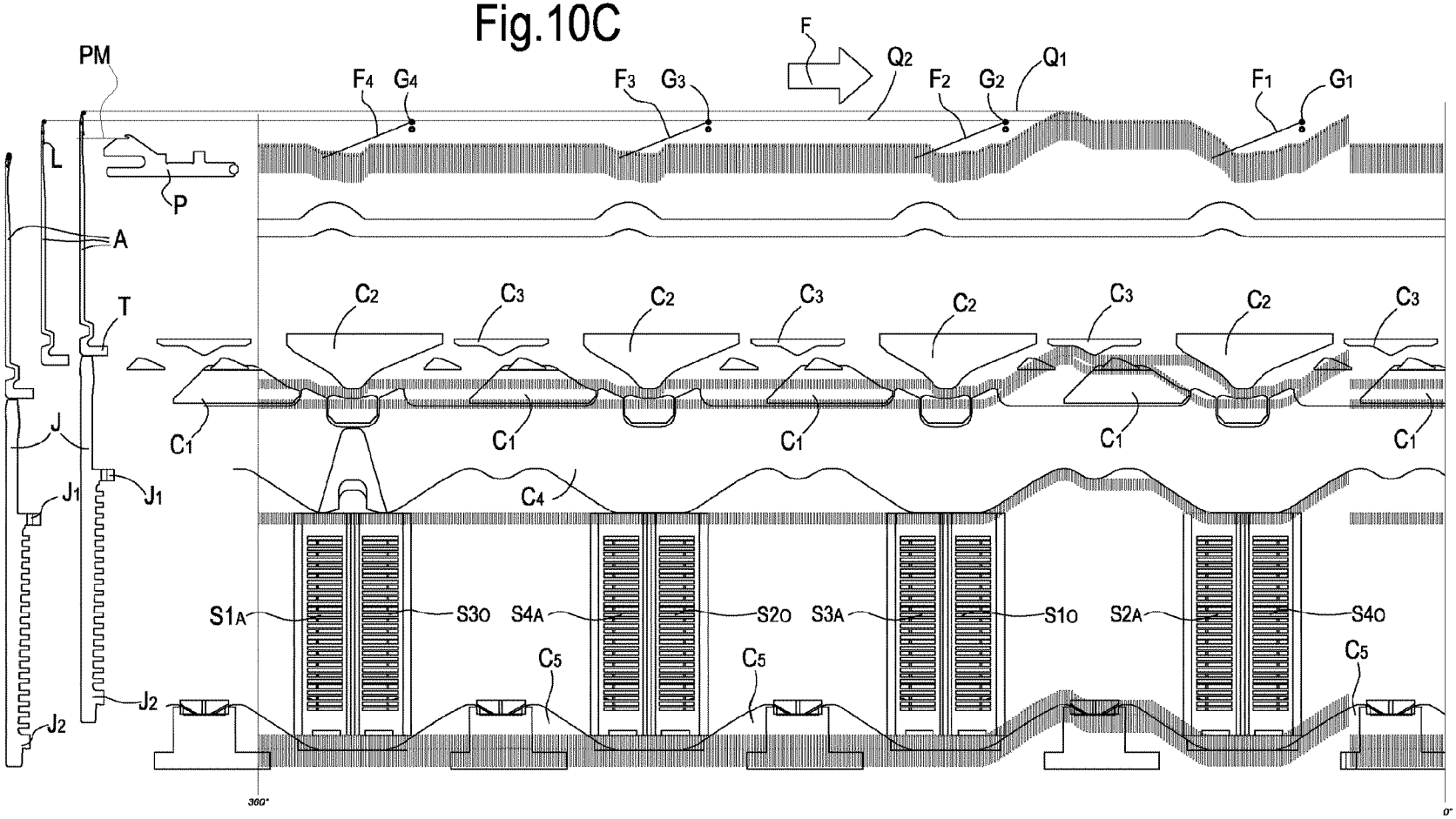

FIGS. 10A, 10B, and 10C show a plan view of a possible configuration of the cam support of the knitting machine with the respective selectors for selecting the needles, that can be used for implementing the knitting method described herein. On the left, two or three needles are schematically shown, indicated with A, in the various positions taken during knitting. T indicates the heels of the needles A. TA and TT indicate respectively the trajectory of the hooks of the needles A and the trajectory of the heels of the needles A. G1, G2, G3 and G4 indicate the yarn guides of the four feeds for the four yarns F1, F2, F3, F4. S1A, S2A, S3A, S4A indicate the selectors for the needles associated with the feeds G1, G2, G3, G4, used in the knitting step with reciprocating motion and operating when the needle cylinder 101 rotates counterclockwise. Vice versa, S1O, S2O S3O S4O indicate the selectors associated with the same feeds G1-G4, used in the clockwise rotation, as described with reference to FIGS. 5A-5M.

C1 and C2 indicate respectively the cams for lifting and lowering the needles. A pair of cams C1, C2 is associated with each feed G1-G4. C3 indicates auxiliary cams for lowering the needles, which operate only while knitting with reciprocating motion, as it will be better explained below. The auxiliary cams C3 are retracted inside the support during continuous-motion knitting, so that they do not act on the heels of the needles A. In FIGS. 10B and 10C the jacks J are also indicated in the two positions that they take selectively, based upon whether the respective needle is selected or inactive. J1 and J2 indicate the upper and the lower heels of the jacks and TJ1 and TJ2 indicate the respective movement trajectories of these heels J1 and J2. TJ indicates the trajectory of the heads of the jacks. The lower parts of FIGS. 10B and 10C show cams C4 for lowering the jacks J; C5 indicates the cams for lifting these jacks J, associated with the various feeds G1-G4 and with the respective selectors.

FIG. 10A schematically represents the operation during the rotation with continuous motion counterclockwise, for instance during the formation of the leg pieces 3, 5 or of the central part 15 of the body 7. The motion of the needle cylinder 101 is represented by means of arrow F. All the needles are working and they all follow the same trajectory TA. The figure shows the knitting members, i.e. the cam support, in a view from the inside of the needle cylinder 101.

FIGS. 10B and 10C show the motion of the needles while knitting the partial rows with reciprocating motion. More in particular, FIG. 10B shows the movement of the needles during the counterclockwise rotation of the needle cylinder 101, while FIG. 10C shows the movement of the needles during the clockwise rotation of the needle cylinder 101. TO indicates the trajectory of the heels of the needles that are not selected, i.e. of the inactive needles, and TT indicates the trajectory of the selected needles. The auxiliary cams C3 are active and cause the partial lowering of each selected needle from a maximum height (indicated with Q1) to an intermediate height (indicated with Q2) before catching the respective yarn coming from the feed with which each auxiliary cam C3 is associated. For instance, FIG. 10B shows the partial lowering from the height Q1 to the height Q2 actuated by the auxiliary cam C3 upstream of the feed G2. As it is shown on the left in FIG. 10B, the height Q2 is such that the needle at this height moves with its own latch L up to the height of the stitch formation plane PM of the sinkers P. The lowering of each selected needle to the height Q2 ensures that the yarn is caught correctly from the respective feed and prevents the yarn from moving under the level of the needle latch. This risk can occur during the reciprocating motion knitting due to the yarn trajectories, but not during the continuous motion knitting, for which the intermediate height of needle partial lowering is therefore not provided.

FIG. 10C shows, using the same criteria and the same reference number as in FIG. 10B, the trajectories of the selected and non-selected (inactive) needles and jacks, during the clockwise motion of the needle cylinder 101 while knitting with reciprocating motion.

As it is clear from the description of the cam support and from the process of knitting the pockets of fabric, with specific reference to FIGS. 4, 6A-6F, during knitting the two pockets of fabric with reciprocating motion all the needles are unloaded, i.e. also during the step when the length of the rows forming the pocket is decreased and increase, each formed stitch is unloaded from the respective needle, so that the fabric has no retained stitches.

Even if in the illustrated embodiment the body is formed with only two side pockets of fabric knitted with reciprocating motion, in other embodiments a greater number of pockets may be formed, for instance two pockets of fabric on each side of the body.

In the process described above it is assumed that an article or garment is produced with a body and two leg pieces, which is completely closed when it is removed from the circular knitting machine, i.e. without openings for wearing the garment, and only provided, as the case may be, with openings in correspondence of the ends of the leg pieces. The opening in correspondence of the waist for wearing the garment is produced once the garment has been removed from the machine, by cutting along the line 13 and applying an elastic edge 11 according to known methods.

Figure 11:
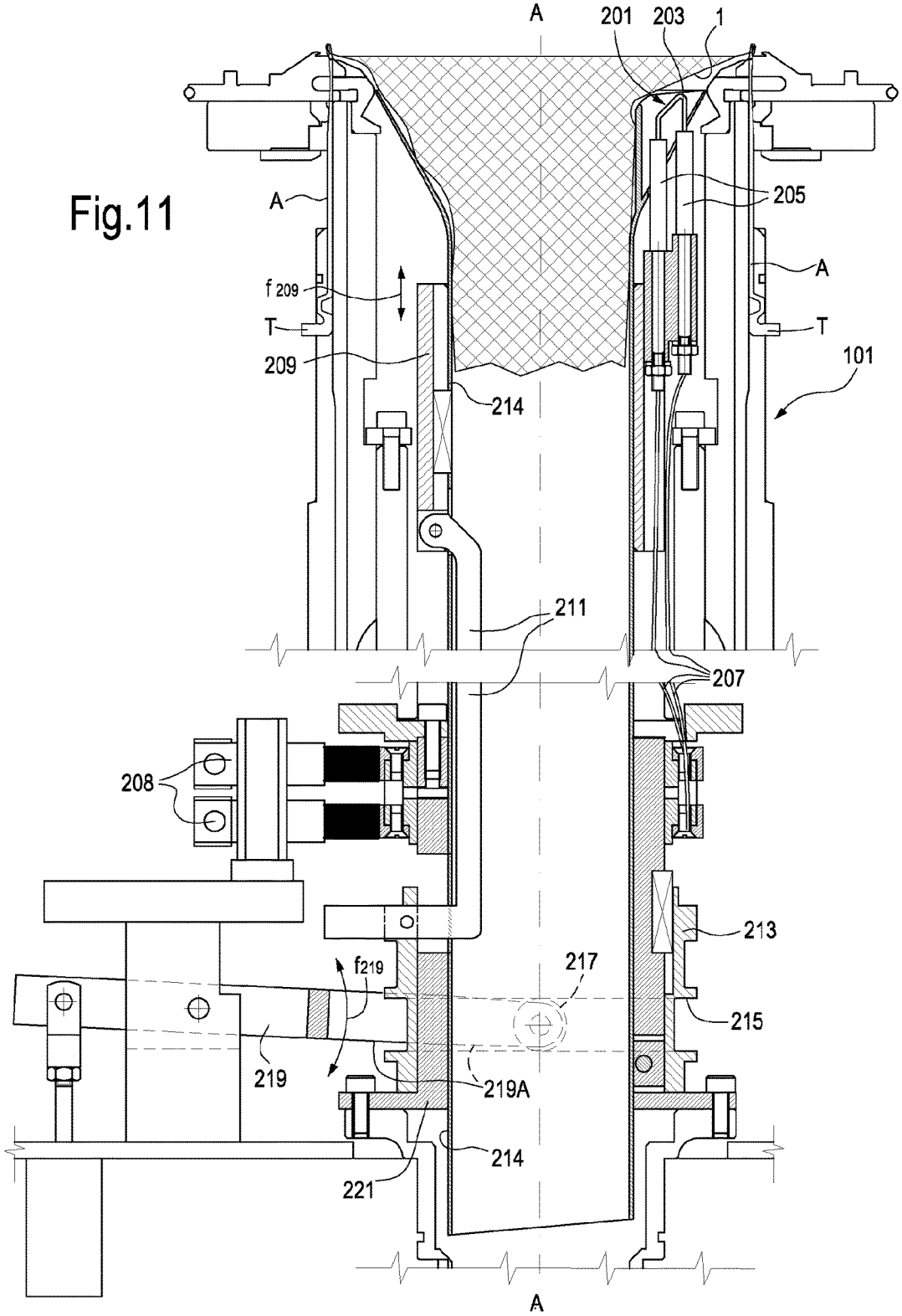
FIGS. 11 and 12 show a longitudinal section of a needle cylinder with a system for making the opening in the body by means of an electrical resistor, while knitting.
Figure 12:
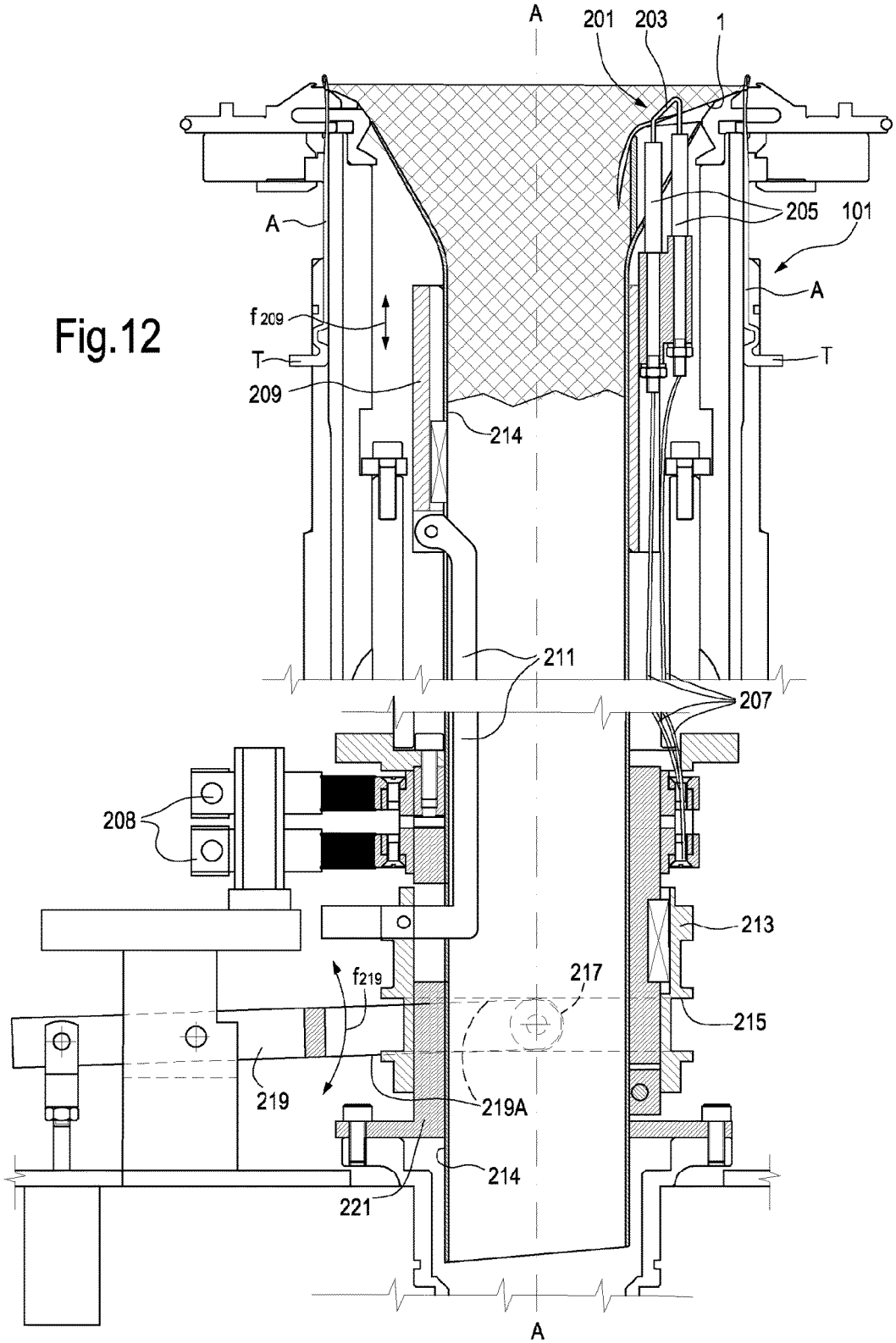

FIGS. 11 and 12 show a partial longitudinal cross-section of a cylinder 101 of a circular knitting machine with a cutting device for cutting the article or garment being produced while knitting this latter by means of the circular needle bed of the cylinder 101. 201 generically indicates the cutting device.

In some embodiments, the cutting device 201 comprises an electrical resistor 203, i.e. an element that is heated by Joule effect by means of a current flowing through it.

The electrical resistor 203 can be electrically connected to two electric wires by means of a connector 205. Each electric wire 207 is into electric contact with a contact brush 208. These contact brushes power the electric resistor 203 while it rotates together with the cylinder 101 of the needles A.

The electric resistor 203 and the connectors 205 can be supported by an annular support element 209 surrounding the axis A-A of the needle cylinder and rotating with the needle cylinder 101. The support element 209 is provided with a vertical movement, i.e. a movement parallel to the axis A-A of the needle cylinder, according to the arrow f209, so as to take alternatively two positions shown respectively in FIGS. 11 and 12. In the first position (FIG. 11) the support element 209 and the electric resistor 203 are in the lowest position. The electric resistor 203 is disengaged from the knitted article or garment 1 being knitted by the needles A of the needle cylinder 101. In this condition, the cutting device 201 does not act onto the article or garment 1 being formed.

In FIG. 12 the support element 209 and the cutting device 201 are in the upper, or lifted, position. The electric resistor 203 penetrates the article or garment 1 being knitted. The heat generated by the electric resistor 203 locally melts the yarns forming the knitted article, generating an opening therein. The opening extends in the direction of the column of stitches, i.e. orthogonally to the rows of stitches.

The lifting and lowering movement of the electric resistor 203 is synchronized with the knitting process, so that the opening is made in the required position.

According to some embodiments, the operation of the cutting device 201 can be such as to act on the knitted article once the knitting has been stopped. For instance, it is possible firstly to knit a first portion of the body as described above and then activate the cutting device 201. The knitting machine is stopped and the device 201 is lifted to cut an opening portion in the garment held on the needle cylinder. Then, the cutting device 201 is lowered, i.e. it is made inactive and knitting starts again to form a subsequent portion of the article or garment 1. Then the knitting machine is stopped again and the cutting process is repeated by lifting the cutting device again. The process is repeated until an opening of sufficient length is made. This process requires time but the cutting device 201 does not necessarily need to rotate in synchronous way with the needle cylinder 101.

According to preferred embodiments, to accelerate the knitting process, the cutting device 201 rotates together with the needle cylinder 101. In this way the cutting device 201 can be lifted and held in lifted active position for the time necessary to knit the portion of body that shall be cut (yarn melting). Once a sufficiently long opening has been made, the knitting continues while the cutting device 201 is made inactive and brought into the lowered inactive position.

FIGS. 11 and 12 show this last embodiment, wherein the cutting device 201 rotates synchronously with the needle cylinder 101. In some embodiments the support element 209 is mounted on a vertical upright 211 extending downwards towards a ring 213. The ring 213 rotates around the axis A-A of the needle cylinder 101 together with the needle cylinder 101 and a collection duct 214 for the garment 1. The upper part of the collection duct 214 for collecting the garment can be funnel-shaped to facilitate the collection of the article or garment 1 inside the duct 214.

The ring 213 can be provided with an annular channel 215 engaging rollers or wheels 217 that can be supported by a movable arm 219 ending with a distal portion 219A in the shape of a fork, carrying the wheels 217. In some embodiments, the arm 219 may be articulated to a stationary structure of the knitting machine around a horizontal axis. An actuator 221 can be provided to oscillate the arm 219 according to the double arrow f219. The oscillation of the arm 2189 controls the lifting and lowering movement of the ring 213 and of the support element 209 by means of the upright 211. The wheels 217 engage in the annular channel 215 and allow the upright 211, the ring 213 and the support element 209 to rotate together with the needle cylinder 101 around the axis A-A of the same cylinder. In this way, the electric resistor 203 can rotate together with the needle cylinder 101 and can move vertically according to the arrow f209 from the position of FIG. 11 to the position of FIG. 12 and vice versa.

In other embodiments a different cutting device may be used, for instance comprising a laser source, or a mechanical cutting device instead of the electric resistor 203. In some embodiments, for instance, when a laser beam is used, the vertical movement for actuating and deactuating the cutting device may be omitted.

Figure 13:
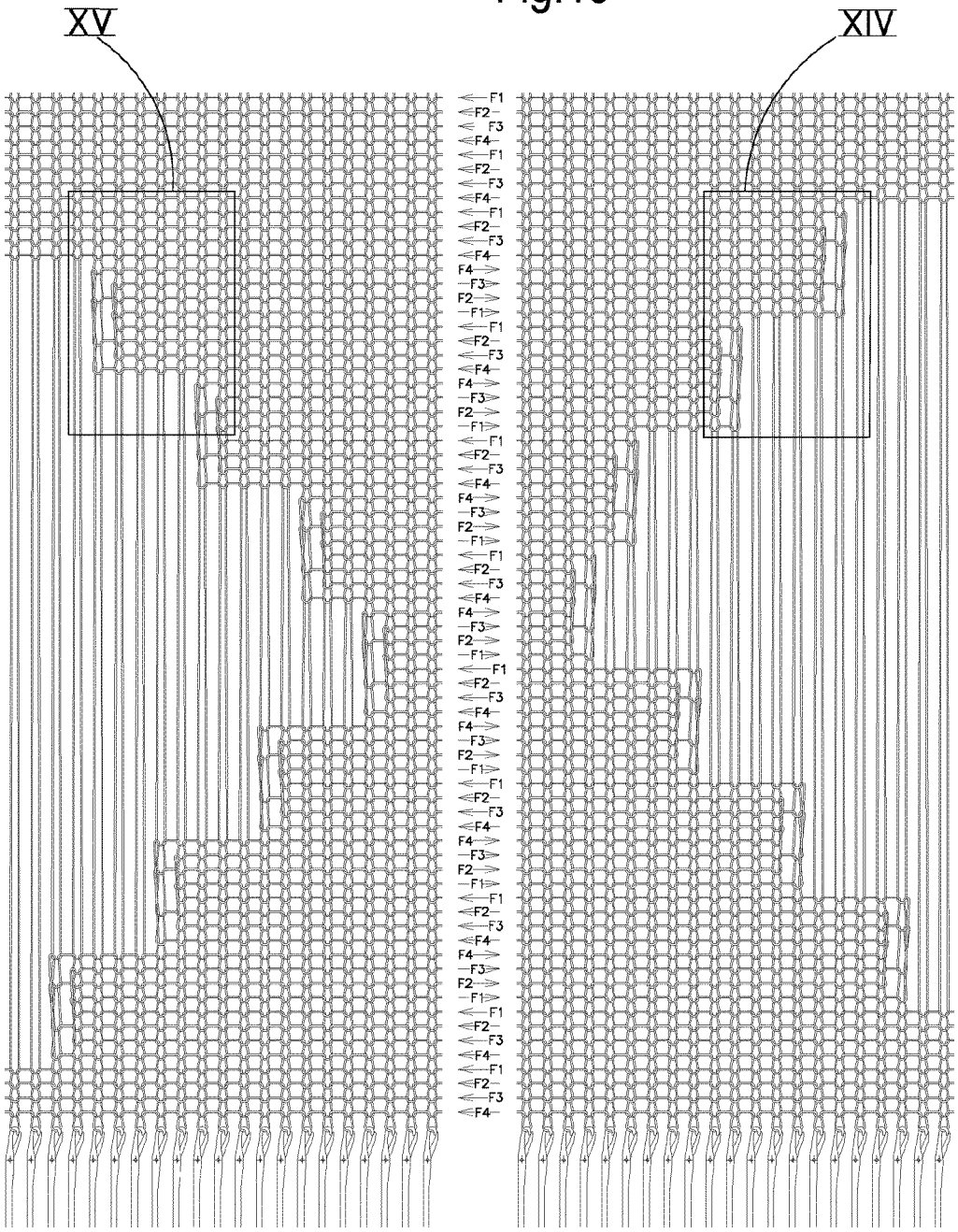
FIGS. 13, 14, and 15 show a scheme for knitting one of the pockets of fabric forming the body, in a modified embodiment, FIGS. 14 and 15 being enlargements of the details XIV and XV of FIG. 13.
Figure 14:
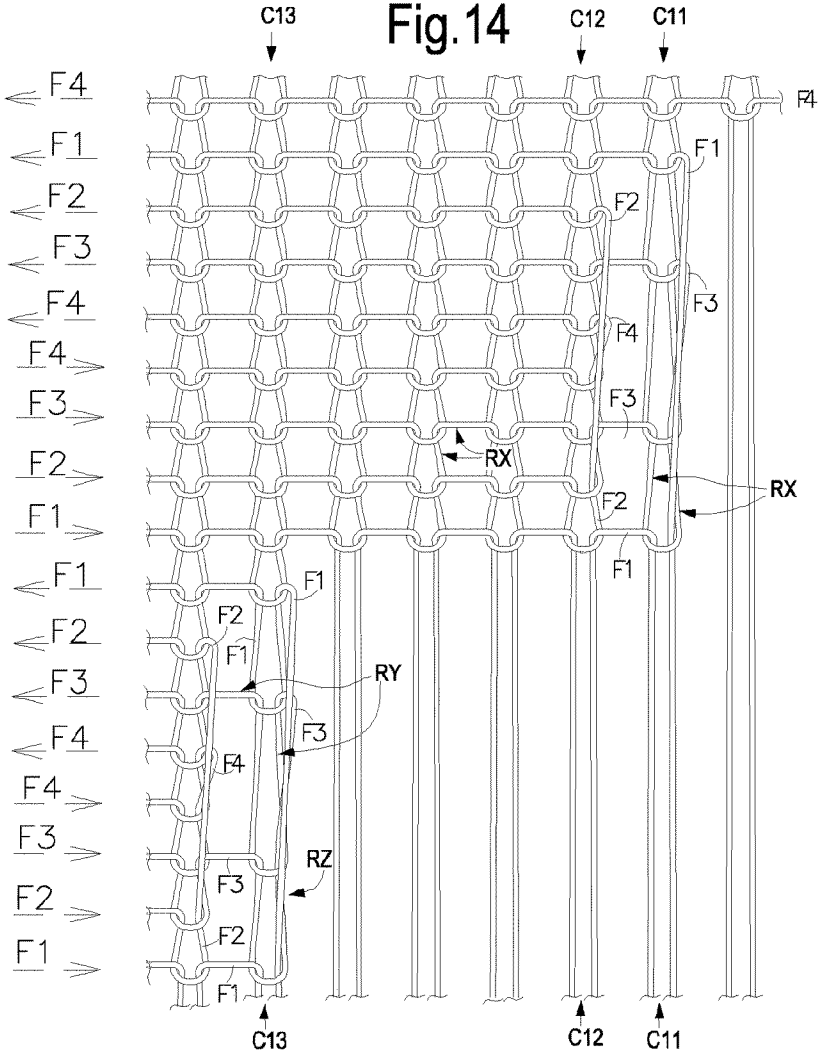
Figure 15:
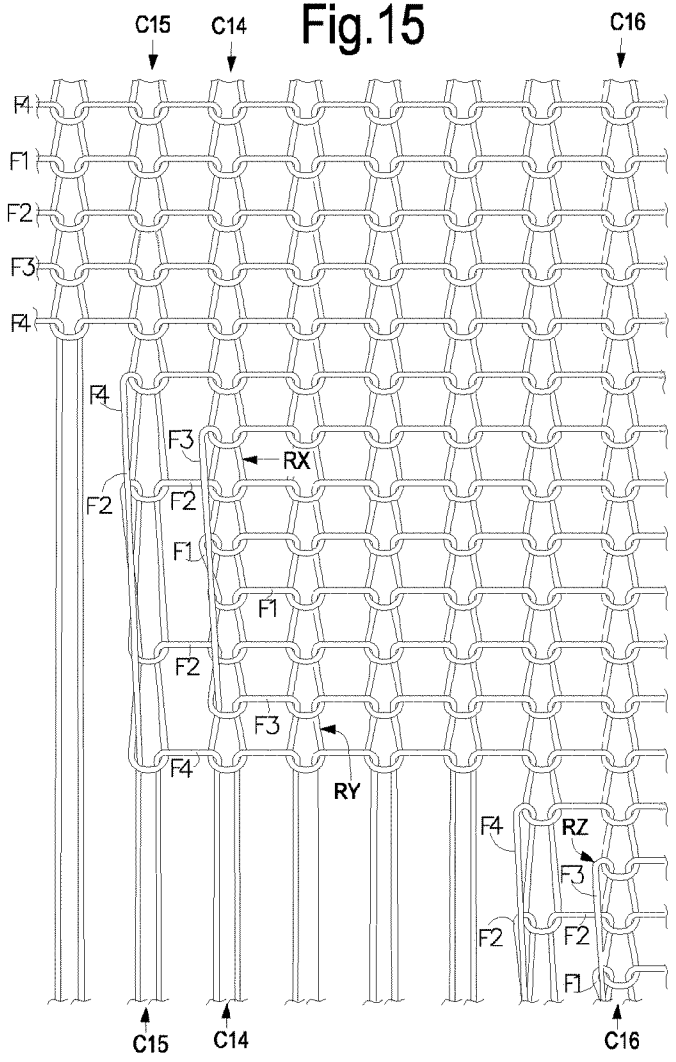

FIGS. 13, 14 and 15 illustrate a portion of the pockets of fabric and relevant arrangement of stitches in a way similar to FIGS. 4 and 6*f*, in a modified embodiment. Reference numbers F1, F2, F3 and F4 indicate the yarns of the four feeds. The arrows in the central portion of FIG. 4 and between the enlargements of FIGS. 14 and 15 (showing enlargements of portions XIV and XV of FIG. 13) indicate the direction of motion of the knitting cylinder during the formation of the respective stitch rows. In the exemplary embodiment shown four feeds and corresponding four yarns are used. A different number of yarns, preferably an even number of yarns, such as six or eight yarns, can be used instead. Reference numbers Rx, Ry and Rz indicate selected courses or rows of stitches. Each row of stitches are formed by the same yarn during the same revolution of the needle cylinder 101, b subsequent needles A thereof. Reference numbers C11, C12, C13, C14, C15 and C16 indicate columns of stitches, stitches of each column being formed by the same needle A of the needle cylinder 101.

As can be seen in particular in the enlargements of FIGS. 14 and 15 at each the end of each reciprocating stroke two rows of stitches are shifted with respect to the other two rows of stitches. More specifically, in FIG. 14 the rows of stitches formed by yarns F1 and F4 are shifted towards the right by one stitch with respect to the two rows of stitches formed by yarns F2 and F4. In the reversal movement, the two rows of stitches formed by yarns F2 and F4 are shifted by one stitch towards the left with respect to the two rows of stitches formed by yarns F1 and F3. Referring e.g. to the first partial row of FIG. 14, yarns F1 and F3 form the terminal stitch in column C1. Conversely, yarns F2 and F4 form the terminal stitch in adjacent column C12. On the other end (FIG. 15) the yarns F1 and F3 terminate the stitch formation with respective terminal stitches in column C14, while yarns F2 and F4 terminate the stitch formation in adjacent column C15.

Similarly to the previously described embodiment shown e.g. in FIG. 4, therefore, rows of stitches formed by different yarns in the same reciprocating stroke are shifted. Differently from FIG. 4, however, not every row is shifted with respect to the other, but they are paired, i.e. the rows formed by yarns F1 and F3 are aligned to one another, such that the terminal or end stitch of both rows are located in the same stitch column, e.g. column C11, see FIG. 14. The rows formed by yarns F2 and F4 are aligned to one another as well, e.g. along column 12, see FIG. 14. However rows formed by yarns F1 and F3 are shifted (by one stitch in the embodiment shown in FIGS. 13, 14, 15) with respect to the rows formed by yarns F2, F4. Shifting by one stitch is by way of example, it being understood that the rows of stitches formed by yarns F1, F3 could be shifted by more than just one stitch (i.e. one column) with respect to the rows formed by yarns F2, F4.

Moreover, in the embodiment of FIGS. 13, 14 and 15 the length of each row of stitches is reduced only at one end rather than at both ends of the row, contrary to the previously described example. This can be best understood by looking e.g. at FIGS. 14 and 15.

Let's consider by way of example yarn F3, but the same holds true for the remaining yarns F1, F2, F4. In FIG. 15 the row Rx of stitches formed by yarn F3 comprises a terminal stitch formed on a needle which generates the column C14 of stitches. I.e. the row Rx has a first terminal stitch in column C14. The same row Rx has a second terminal stitch in column C11, see FIG. 14. Thus, row Rx has a length which spans from column C11 to column C14.

Upon reversal of the needle cylinder rotation, the same yarn F3 starts with the formation of a next row or course of stitches Ry. The first stitch (FIG. 15) on the left end of the row Ry is formed in the same stitch column C14. The row Ry however terminates on the opposite side at column C13, i.e. is shorter than previously formed row Rx. In the embodiment shown in FIGS. 13, 14 and 15 the rows Rx, Ry (i.e. two subsequent rows formed by the same yarn upon reversal of the reciprocating rotary motion of the needle cylinder 101) have a difference in length equal to five stitches, i.e. column C11 and column C13 are distanced by five stitches. In other embodiments this difference in length can be grater or smaller than five. What matters is that each yarn generates courses of stitches, the length whereof reduces only upon every two reversals of the rotary motion. In other words, each yarn reduces the number of stitches formed upon reversal of the motion only at one end, but not at the opposite end of the row. In fact, if the same yarn F3 is considered again, upon reversal of the motion the next row Rz formed by said yarn starts in column C13 (i.e. same column where row Ry terminates) but will extend only until column C16, i.e. row Rz is five stitches shorter than row Ry.

The embodiments described above and illustrated in the drawings have been explained in detail as examples of embodiment of the invention. It will be clearly apparent to those skilled in the art that modifications, variants, additions and omissions are possible, without however departing from the principles, the scope of the concept and the teachings of the present invention as defined in the attached claims. The scope of the invention shall be therefore determined exclusively based upon the widest interpretation of the attached claims, wherein these modifications, variants, additions and omissions are included within this scope. The terms "comprising" "to comprise" and the like do not exclude the presence of further elements or steps in addition to those specifically listed in a claim. The term "a" or "an" before an element, means or feature of a claim does not exclude the presence of a plurality of these elements, means or features. If a claim of a device claims a plurality of "means", some or all these "means" can be actuated by a single component, member or structure. The enunciation of given elements, features or means in distinct depending claims does not exclude the possibility of combining said elements, features or means together. When a method claim lists a sequence of steps, the sequence with which these steps are listed is not binding and can be changed, if the particular sequence is not indicated as binding. Any reference numerals in the appended claims are provided to facilitate reading of the claims with reference to the description and to the drawing, and do not limit the scope of protection represented by the claims.

The invention claimed is:

1. A method for producing a knitted article with two leg pieces and a body on a circular knitting machine with at least one circular needle bed, the method comprising the following steps:

knitting with continuous motion a first leg piece with a plurality of feeds;

knitting with reciprocating motion a first pocket of fabric with a plurality of feeds, starting from an end row of the first leg piece, said first pocket of fabric forming a first side part of the body, wherein said step of knitting the first pocket of fabric comprises:

knitting a first sequence of partial rows with reciprocating motion, starting from the first leg piece, gradually reducing a number of operating needles to form partial rows of gradually decreasing length, up to a group of partial rows of minimal length;

knitting a second sequence of partial rows with reciprocating motion, starting from the group of partial rows of minimal length, gradually increasing the number of operating needles to form partial rows of gradually increasing length;

knitting with reciprocating motion a second pocket of fabric with a plurality of feeds, up to a start row of a second leg piece, said second pocket of fabric forming a second side part of the body, wherein said step of knitting the second pocket of fabric comprises:

knitting a third sequence of partial rows with reciprocating motion, gradually reducing the number of operating needles to form partial rows of gradually decreasing length, up to a group of partial rows of minimal length;

knitting a fourth sequence of partial rows with reciprocating motion, starting from the group of partial rows of minimal length, gradually increasing the number of operating needles to form partial rows of gradually increasing length;

knitting with continuous motion the second leg piece with a plurality of feeds, wherein during the steps of knitting with reciprocating motion, each time the circular needle bed rotates in one direction and each time the circular needle bed rotates in an opposite direction a plurality of rows is formed in a number corresponding to the number of feeds, wherein, during the step of knitting the first pocket of fabric and the second pocket of fabric with said reciprocating motion, rows are formed with gradually decreasing and gradually increasing length by controlling the needles so that all the operating needles are unloaded.

2. A method according to claim 1, further comprising the steps of:

arranging a plurality of feeds around the circular needle bed, each feed comprising a feed structure for feeding the circular needle bed with a respective yarn, a cam for lifting the needles and a cam for lowering the needles;

associating to each feed a first selector operated to select the needles while the circular needle bed rotates clockwise, and a second selector operated to select the needles while the circular needle bed rotates counterclockwise;

according to a direction of rotation of the circular needle bed, selectively actuating the first selector or the second selector while knitting the first pocket of fabric and the second pocket of fabric with reciprocating motion.

3. A method according to claim 2, further comprising the step of associating to each feed an auxiliary cam for partial lowering of the needles, said auxiliary cam being active while knitting the first pocket of fabric and the second pocket of fabric with reciprocating motion and being inactive while knitting with continuous motion.

4. A method according to claim 2, wherein said needles are selected by means of the first selector and the second selector acting on selection jacks, one of said selection jacks being associated with each of said needles.

5. A method according to claim 1, wherein after the first pocket of fabric has been knitted with reciprocating motion and before the second pocket of fabric is knitted with reciprocating motion, a central part of the body is formed between said first pocket of fabric and said second pocket of fabric, said central part of the body being knitted with continuous motion with a plurality of feeds.

6. A method according to claim 5, wherein the first pocket of fabric, the second pocket of fabric, the first leg piece, the second leg piece and the central part of the body are knitted with a same number of feeds.

7. A method according to claim 5, wherein the first pocket of fabric, the second pocket of fabric, the central part of the body, the first leg piece and the second leg piece are knitted with an even number of feeds.

8. A method according to claim 5, wherein the first pocket of fabric, the second pocket of fabric, the central part of the body, the first leg piece and the second leg piece are knitted with at least two feeds.

9. A method according to claim 8, wherein at least one Z-twist yarn and at least one S-twist yarn are used for forming the first leg piece, the second leg piece, the first pocket of fabric, the second pocket of fabric, and the central portion of the body.

10. A method according to claim 5, wherein the central part of the body has a tubular structure comprising a plurality of complete rows of stitches.

11. A method according to claim 5, wherein said step of knitting said central part of the body with said continuous motion is performed using the whole circular needle bed, knitting a tubular portion of fabric, while the steps of knitting the first pocket of fabric and the second pocket of fabric are performed using a reduced number of needles on an active arc of the circular needle bed, a complementary arc of needles remaining inactive.

12. A method according to claim 1, wherein during the reciprocating motion yarns of all the feeds form a same number of stitches in a rotation in the one direction or in the opposite direction of the needle bed, so that, in each reciprocating rotation during formation of the first pocket of fabric and of the second pocket of fabric, partial rows are formed of equal length and in a number equal to the number of feeds during each one of reciprocating strokes of the circular needle bed.

13. A method of claim 12, wherein during knitting one or more of the first sequence of partial rows and the third sequence of partial rows, row lengths are decreased gradually at both ends of the row.

14. A method of claim 12, wherein during knitting of one or more of the second sequence of partial rows and the fourth sequence of partial rows, row lengths are increased gradually at both ends of the row.

15. A method according to claim 1, wherein, during the formation of the first pocket of fabric and of the second pocket of fabric with said reciprocating motion, the plurality of partial rows formed with a rotation of the needle bed in one direction and the subsequent plurality of partial rows formed with a rotation of the needle bed in the opposite direction are shifted with respect to each other by a number of stitches.

16. A method according to claim 15, wherein said partial rows are shifted with respect to one another by a number of stitches comprised between 2 and 15.

17. A method according to claim 1, further comprising the step of generating an opening in the body while knitting the body.

18. A method according to claim 17, wherein the opening of the body is formed by means of a heating element, that melts yarns forming stitches of the body along an opening line.

19. A method according to claim 1, further comprising the step of closing ends of the leg pieces.

20. A method according to claim 1, wherein during knitting of said first pocket of fabric and said second pocket of fabric pairs of rows formed by respective pairs of yarns are shifted with respect to one another such that terminal stitches of at least one pair of non-consecutive rows are arranged in a column of stitches, which is shifted with respect to a column of stitches where terminal stitches of at least another pair of non-consecutive rows are arranged.

21. A knitted garment comprising:

a body and two tubular leg pieces, wherein the body comprises two side pockets of knitted fabric, each of said two side pockets being formed by a first series of partial rows, constituting an extension of a knitted fabric forming the two tubular leg pieces, rows of said first series of partial rows having decreasing length starting from a respective leg piece up to a group of partial rows of minimal length of a respective pocket, and each of said two side pockets being formed by a second series of partial rows, having increasing length starting from a respective group of partial rows of minimal length up to a respective complete row, wherein said two side pockets of knitted fabric are formed with a plurality of feeds with reciprocating motion, and wherein all stitches forming the two side pockets of knitted fabric of the body are cleared stitches.

22. A garment according to claim 21, wherein the body further comprises, between the two side pockets of fabric, a central portion formed with continuous motion with a plurality of feeds.

23. A garment according to claim 21, wherein each of said two side pockets of fabric is formed with at least two feeds.

24. A garment according to claim 21, wherein the two tubular leg pieces comprise a tubular fabric formed with continuous motion with a plurality of feeds.

25. A garment according to claim 21, wherein the two side pockets of knitted fabric, the leg pieces and the central part of the body are all formed with an equal number of feeds.

26. A garment according to claim 21, wherein the partial rows formed with the plurality of feeds and corresponding to each reciprocating knitting movement are shifted with respect to one another, so that ends of the partial rows are spaced from one another by a number of stitches comprised between 2 and 15.

27. A garment according to claim 21, wherein the partial rows are subdivided into groups of partial rows, each of said partial rows comprising a number of rows equal to a number of feeds used for knitting, wherein the partial rows of each group of partial rows have the same length.

28. A garment according to claim 21, further comprising rows formed with S-twist yarns and Z-twist yarns.

29. A knitting machine comprising a needle cylinder with a circular needle bed, a cam mantle and selectors, a plurality of feeds, and a control unit, wherein said control unit executes a program implementing a knitting method comprising:

knitting with continuous motion a first leg piece with said plurality of feeds;

knitting with reciprocating motion a first pocket of fabric with said plurality of feeds, starting from an end row of the first leg piece, said first pocket of fabric forming a first side part of the body, wherein said step of knitting the first pocket of fabric comprises:

knitting a first sequence of partial rows with reciprocating motion, starting from the first leg piece, gradually reducing a number of operating needles to form partial rows of gradually decreasing length, up to a group of partial rows of minimal length;

knitting a second sequence of partial rows with reciprocating motion, starting from the group of partial rows of minimal length, gradually increasing the number of operating needles to form partial rows of gradually increasing length;

knitting with reciprocating motion a second pocket of fabric with said plurality of feeds, up to a start row of a second leg piece, said second pocket of fabric forming a second side part of the body, wherein said step of knitting the second pocket of fabric comprises:

knitting a third sequence of partial rows with reciprocating motion, gradually reducing the number of operating needles to form partial rows of gradually decreasing length, up to a group of partial rows of minimal length;

knitting a fourth sequence of partial rows with reciprocating motion, starting from the group of partial rows of minimal length, gradually increasing the number of operating needles to form partial rows of gradually increasing length;

knitting with continuous motion the second leg piece with said plurality of feeds, wherein during the steps of knitting with reciprocating motion, each time the circular needle bed rotates in one direction and each time the circular needle bed rotates in an opposite direction a plurality of rows is formed in a number corresponding to the number of feeds, wherein, during the step of knitting the first pocket of fabric and the second pocket of fabric with said reciprocating motion, rows are formed with gradually decreasing and gradually increasing length by controlling the needles so that all the operating needles are unloaded.

30. A knitting machine comprising:

a needle cylinder with a circular needle bed;

a plurality of feeds around the circular needle bed, each of said feeds comprising a feed for feeding the circular needle bed with a respective yarn, a cam for lifting the needles and a cam for lowering needles;

associated to each feed, a first selector, designed and controlled to select the needles of the circular bed while the needle cylinder rotates clockwise, and a second selector, designed and controlled to select the needles of the circular bed while the needle cylinder rotates counterclockwise.

31. A machine according to claim 30, wherein an auxiliary cam is associated with each feed for lowering a needle, designed and controlled to be operated during a reciprocating motion of the needle cylinder.

32. A machine according to claim 30, wherein each needle of the circular bed is associated with a single selection jack, onto which said first selector and said second selector act selectively.

33. A method according to claim 3, wherein said needles are selected by means of the first selector and the second selector acting on selection jacks, one of said selection jacks being associated with each of said needles.

34. A method according to claim 2, wherein after the first pocket of fabric has been knitted with reciprocating motion and before the second pocket of fabric is knitted with reciprocating motion, a central part of the body is formed between said first pocket of fabric and said second pocket of fabric, said central part of the body being knitted with continuous motion with a plurality of feeds.

35. A method according to claim 34, wherein the first pocket of fabric, the second pocket of fabric, the central part of the body, the first leg piece and the second leg piece are knitted with an even number of feeds.

36. A garment according to claim 22, wherein each of said two side pockets of fabric is formed with at least two feeds.

37. A garment according to claim 22, wherein the two tubular leg pieces comprise a tubular fabric formed with continuous motion with a plurality of feeds.

* * * * *